US005159793A

United States Patent [19]

Deugo et al.

[11] Patent Number: 5,159,793

[45] Date of Patent: Nov. 3, 1992

[54] WALL SYSTEM

[75] Inventors: L. Scott Deugo, St-Lazare; Andrew Mansfield, Rigaud; Michael Salzman, Montreal; Bernhard von Huene, Pincourt; Eberhard von Huene, Hudson, all of Canada

[73] Assignee: Krueger International Inc., Green Bay, Wis.

[21] Appl. No.: 360,861

[22] Filed: Jun. 2, 1989

[51] Int. Cl.[5] ..... E04D 15/00; E04B 2/78

[52] U.S. Cl. ..... 52/126.1; 52/243.1

[58] Field of Search ..... 52/126.3, 126.4, 243, 52/243.1, 238.1, 241, 126.5, 64, 69

[56] References Cited

U.S. PATENT DOCUMENTS

| | | | |
|---|---|---|---|
| 2,558,428 | 6/1951 | Fuller et al. | 52/241 |
| 3,453,789 | 7/1969 | Stephenson | 52/241 |
| 3,603,049 | 9/1971 | Pierce | 52/241 |
| 4,120,124 | 10/1978 | Temple et al. | 52/243.1 |
| 4,165,588 | 8/1979 | Bayley | 52/243.1 |
| 4,450,658 | 5/1984 | Legeai | 52/126.3 |
| 4,454,690 | 6/1984 | Dixon | 52/126.3 |
| 4,555,880 | 12/1985 | Gzym et al. | 52/126.4 |
| 4,936,067 | 6/1990 | Menchetti | 52/241 |

FOREIGN PATENT DOCUMENTS

| | | |
|---|---|---|
| 8318611 | 11/1983 | Fed. Rep. of Germany . |
| 2552471 | 9/1983 | France . |
| 0298433 | 1/1989 | Italy . |
| 0147801 | 12/1983 | Japan . |

*Primary Examiner*—David A. Scherbel
*Assistant Examiner*—Michele A. VanPatten
*Attorney, Agent, or Firm*—Fuller, Ryan, Hohenfeldt & Kees

[57] ABSTRACT

A non-progressive wall system is composed of versatile and interchangeable panels and other components. The wall system panels may be opaque or transparent. The panels comprise superstructures that are pivotable about base assemblies. In the vertical attitude, the tops of the superstructures are releasably coupled to ceiling rails by upper glide assemblies. The panels are rigidly interconnected to each other by panel connectors that slide within the superstructures between storage and installed positions. The wall system further comprises corner posts that provide two, three, or four way junctions for the panels. A door module may be installed at any desired location in the wall system. Decorative covers over the working parts provide a neat and attractive appearance.

60 Claims, 11 Drawing Sheets

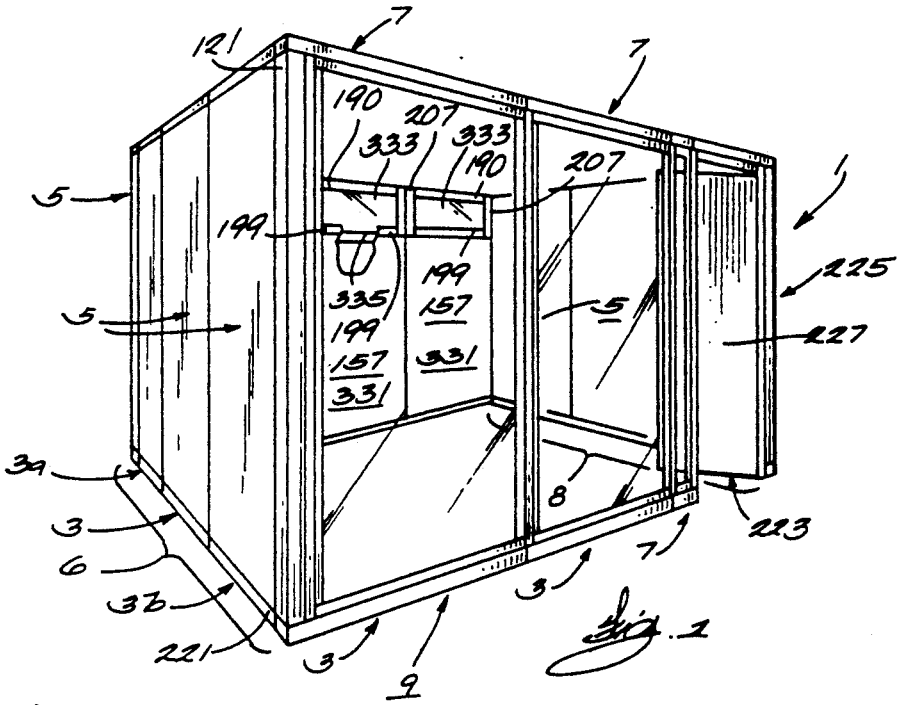
Fig. 1
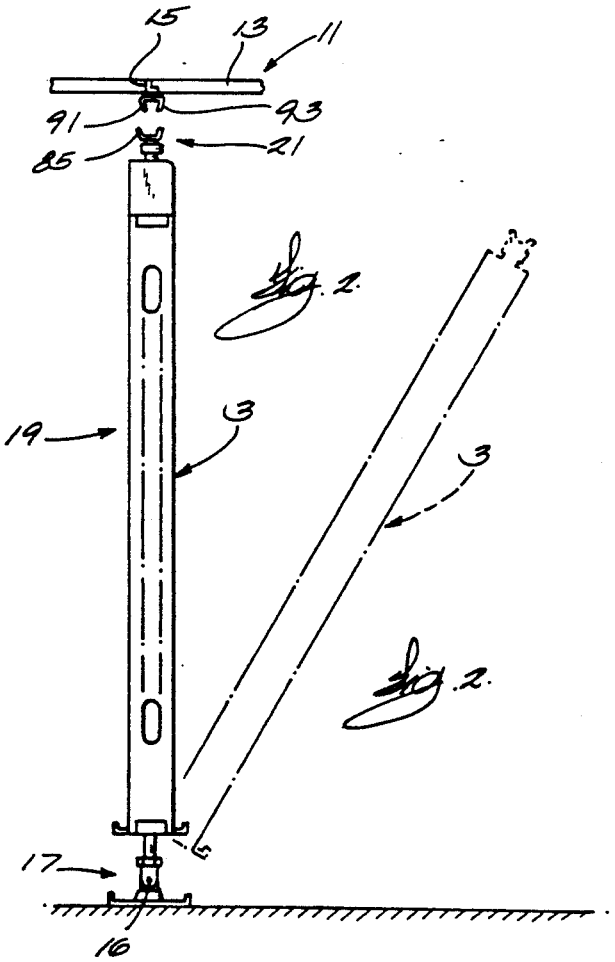
Fig. 2.
Fig. 2.

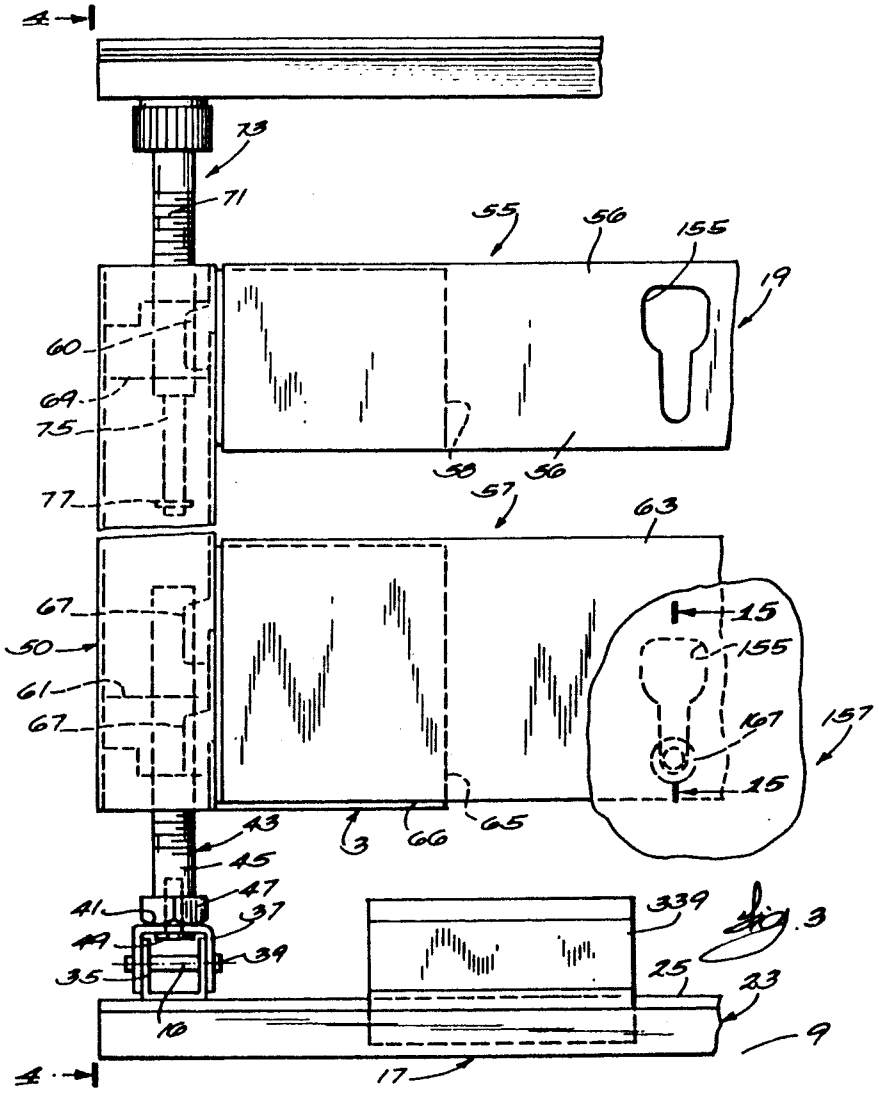
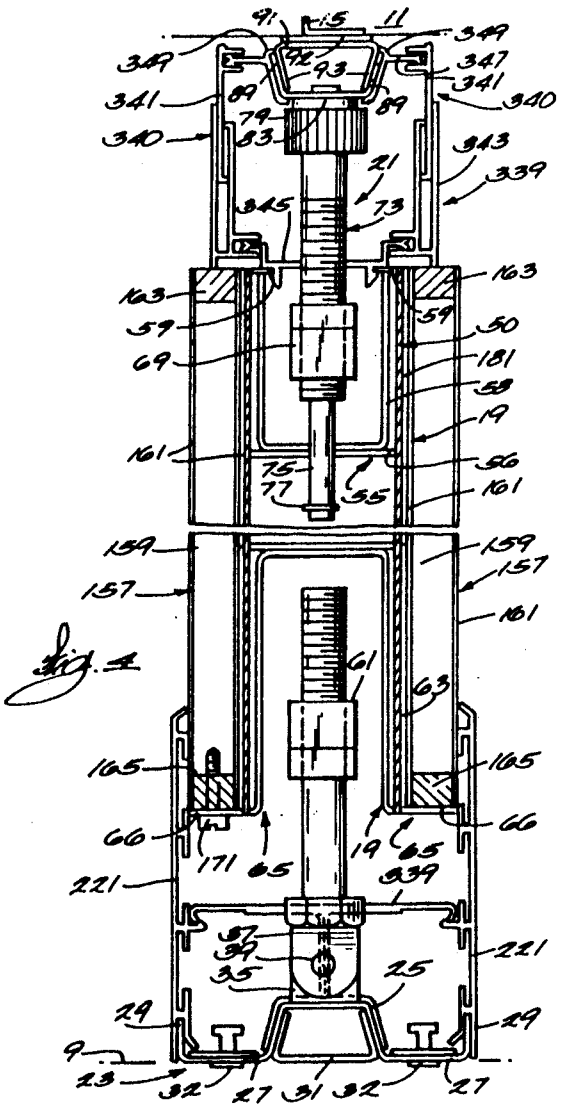

95b
97b
99b
107b
80b
103b
69b
61b
111b
113b
115b
111
110b
69
50
55
57
3b
3
2
1
95
107
111a
69a
61
109
119
45
103
105
46
61a
3a

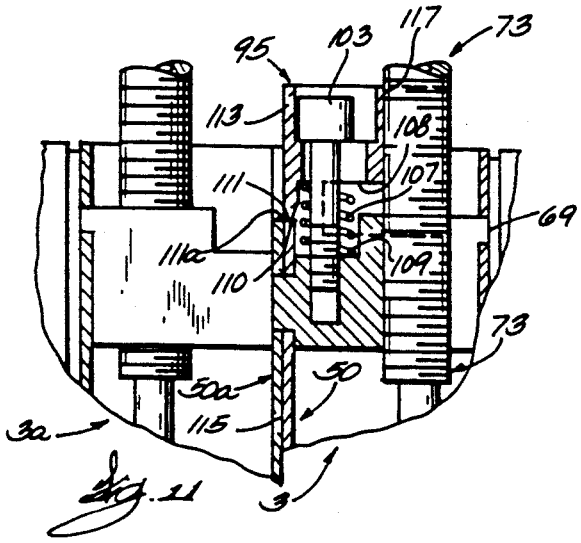
Fig. 11
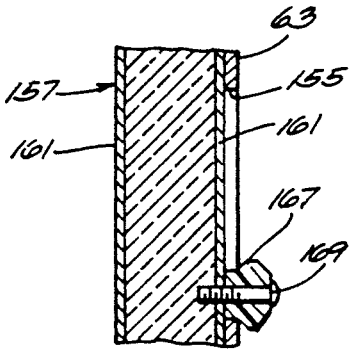
Fig. 15
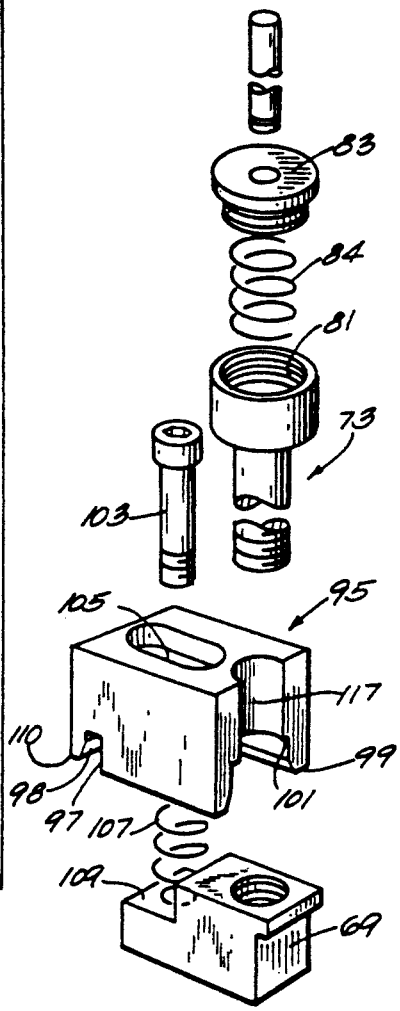
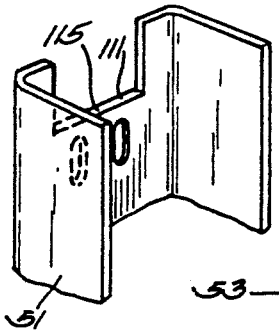
Fig. 10
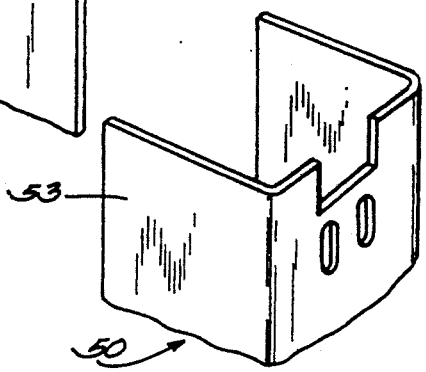

WALL SYSTEM

BACKGROUND OF THE INVENTION

1. Field of the Invention

This invention pertains to building construction, and more particularly to apparatus associated with partitioning building interiors.

2. Description of the Prior Art

Designers of modern offices recognize the problems associated with combining flexible work place construction with comfortable and productive surroundings. Modular work stations and ergonomic furniture have played a large part in meeting those problems.

Another important aspect of modern furniture design concerns the partitioning of large spaces into smaller spaces. It is well known to use walls, doors, floor panels, and other components to balance the needs of worker privacy with efficient work flow.

Traditionally, office partitions were of a more or less permanent nature. A framework was constructed between the building ceiling and floor. The framework was covered with decorative panels, wallboard, or similar components, which also were intended to be permanently installed. However, it has been found that modern office layouts are remodeled on an average of every three years to meet changing work place needs. Changing the traditionally constructed walls is a time consuming, noisy, and messy job.

To increase the versatility of office designs, some buildings make use of the "open concept", which eliminates permanent walls. Rather, a large area is partitioned into smaller areas with acoustical and privacy floor panels of various heights and constructions. Another approach is to create smaller spaces from an open area by using a demountable wall construction. A demountable system typically includes a framework and other components that are designed to be removed at a future time. Some of the components are reusable in new system arrangements constructed at a later time. Typically, about 40 to 50 percent of the components of a demountable system are reusable.

An improvement of the demountable concept is the movable wall system. In that design, a panel can be removed from an installed location and reused at a new location. Up to about 90 to 95 percent of the components of a movable wall system are normally reusable. Some movable wall systems are progressive in nature. In a progressive system, changing a selected panel intermediate the ends of a wall requires that an end panel and consecutive adjacent panels be removed in sequence until the selected panel is reached. Changing a progressive system is an undesirably lengthy and expensive task, as is recognized by those working in the art.

To overcome the drawbacks of the demountable, movable, and progressive wall systems, the fully non-progressive wall system was developed. A non-progressive wall system comprises a series of panels that are constructed to be entirely modular and interchangeable. Any selected panel along a wall can be completely removed without first removing any other panels. Each panel is supported primarily at the ceiling and floor, usually with minimal interpanel connection.

However, prior non-progressive panel systems suffer certain disadvantages. For example, some designs require cumbersome upward lever action against the bottom of a panel in order to remove it from the wall. In another design, variations in floor level are compensated by saddles and shims, which require considerable time and skill for adjusting.

Thus, a need exists for a building partition system that is simpler to install and remove than is presently available.

SUMMARY OF THE INVENTION

In accordance with the present invention, a non-progressive wall system is provided that combines construction versatility with aesthetic appeal. This is accomplished by apparatus that includes modular panels and other components that are readily erected and interchanged to form partitions of desired configurations.

The basic component of each wall system panel is a superstructure comprised of a four-sided frame having parallel vertical posts that are spaced apart by top and bottom horizontal distance channels. The vertical posts and the distance channels are rigidly connected into a sturdy picture-frame assembly.

A variety of coverings can be used to overlie and span the superstructure. In one embodiment of the invention, molding clips and covers are attached to the superstructure vertical posts and distance channels. The molding clips and covers are designed to accommodate seals that receive a pane of window glass, thereby forming a transparent panel.

In another embodiment, a pair of opaque coverings are hung in parallel fashion on opposite faces of the superstructure. For that purpose, the superstructures are formed with vertically extending keyhole slots. Button and stud assemblies on each covering are insertable into the keyhole slots, and the covering is lowered until the bottom edge thereof rests on a ledge on the bottom distance channel. In that manner, the buttons retain the covering horizontally to the superstructure, and the bottom distance channel ledge supports the covering weight. The coverings may be constructed as two spaced shells filled with sound absorbing material. The exposed faces of the shells may be covered with any desired decorative material.

By providing a center distance channel between the top and bottom distance channels, a clerestory panel can be constructed. An opaque covering is assembled to the superstructure between the center and bottom distance channels, and a transparent covering is assembled between the center and top distance channels.

It is an outstanding feature of the present invention that the panel superstructures are supported off the floor by pivotable base assemblies. Each base assembly comprises a floor channel, to which is pivotally connected at least two base glide assemblies. Each base glide assembly includes a vertically oriented screw or glide that is supported for rotation about a generally vertical axis on a clevice. The clevice, in turn, is pivotable about a horizontal axis. The glide threads mate with the superstructure. Accordingly, rotating the glide causes the superstructure to vary in height above the floor. In that manner, variations in the levelness of the floor are readily compensated.

To hold the pivotable panels upright, each panel includes at least one and preferably two upper glide assemblies. Each upper glide assembly comprises an adjusting barrel with first threads that engage mating threads in the superstructure. A rod with a threaded cap on one end is slidable within the adjusting barrel. The threads of the cap are matable with second threads on the adjusting barrel. A spring acts between the adjusting barrel and the cap to bias the rod and cap out of the adjusting barrel, but a retaining ring limits rod travel. The rod adjacent the cap is joined to a glide seat. In an uncoupled mode, the cap is threaded into the adjusting barrel second threads with the spring compressed therebetween, and the adjusting barrel is turned partially into the superstructure. With the panel held in a vertical attitude, the glide seat is located under a ceiling rail fastened to the room ceiling above the floor channel. While holding the glide seat stationary under the ceiling rail, the adjusting barrel is rotated further into the superstructure until the cap is unthreaded from the adjusting barrel. At that point, the spring forces the rod, cap, and glide seat upwardly so that the glide seat couples with the ceiling rail. The coupled glide seat and ceiling rail cooperate to hold the panel upright. Then the adjusting barrel is turned outwardly from the superstructure to remate with the cap threads. Further outward turning of the adjusting barrel causes it to bear against the glide seat and the ceiling rail and thereby securely and rigidly lock the panel to the room ceiling.

To interlock adjacent panels the present invention includes at least one and preferably a pair of panel connectors in each panel. Preferably, both panel connectors are installed on the same superstructure vertical post, with one panel connector being near the top of the vertical post and the other near the bottom. Each panel connector has a slotted and counterbored mounting hole through which a screw passes to mount the panel connector to the vertical post. Each panel connector further has a tapered groove adjacent an outside vertical surface. The slotted mounting hole enables the panel connector to be slid between a storage position whereat the outside vertical surface is flush or in back of the outside surface of the superstructure vertical post, and a withdrawn position whereat the vertical outside surface and the groove extend beyond the outside surface of the superstructure vertical post. During shipping and while erecting a panel adjacent a previously installed panel, the panel connectors are slid to the storage position. When the panel is in place coplanar with the adjacent previously installed panel, the panel connectors are slid to their withdrawn positions, such that their respective grooves overlie cooperative portions of the superstructures of the two adjacent panels. The mounting screws are then tightened to draw the panel connectors to an installed position whereat the panel connector grooves receive and grip the cooperating portions of the superstructures of the two adjacent panels to each other. To facilitate manipulating the panel connectors, they are biased by respective springs from their installed to their withdrawn positions.

The modular wall system of the present invention is designed to meet either of two basic installation requirements. In the first installation requirement, the distance between spaced apart parallel walls is governed by the dimensions of modular furniture and other components. The first installation requirement is met by erecting the wall system in a systems or furniture module, wherein the nominal distance between the spaced parallel walls is measured between the inside facing surfaces of the wall panels. In the furniture module, the locations of the walls are largely independent of the locations of any structural members in the building ceiling. With suitable nominal dimensions between the parallel walls, modular furniture and other components fit perfectly between the walls.

In a furniture module installation, junctions between intersecting panels are readily handled by appropriate corner posts. The corner posts may be constructed generally similarly to the vertical posts of the panel superstructures. Top and bottom cap assemblies welded or otherwise fixed to the corner posts contain lips for receiving the panel connectors of adjacent panels. The top and bottom cap assemblies can be fabricated with lips to suit the intersection of 2, 3, or 4 panels. The corner posts do not tilt about the floor, but they do include means for adjusting their heights above the floor.

The wall system of the present invention is also designed to meet a second installation requirement, wherein the walls are erected along a ceiling grid and window mullions pre-existing in the building. The second installation requirement is met by installing the walls in a building module. In the building module, the nominal distance between spaced apart parallel walls is the distance between the corresponding members of the ceiling grid, which is also the distance between the longitudinal center lines of the walls.

The vertical posts of the panel superstructures are fabricated with vertically oriented slots. The slots are arranged to receive hooks that are included on various modular furniture components such that the components can be hung from the panels. The slots are located so as to remain exposed when the decorative covering or glass pane is assembled to the superstructure. To provide a pleasing appearance, a decorative gasket overlies the slots, but the gasket is of a flexible nature that allows easy access to the slots if desired. To provide maximum privacy to persons separated by the wall system of the present invention, a butterfly privacy cover is inserted into the vertical posts of the superstructure, thereby blocking light from passing through the post slots. Additional decorative covers are used between the bottom of the superstructure and the floor, and between the top of the superstructure and the ceiling, thereby covering the lower and upper guide assemblies, respectively.

Further in accordance with the present invention, a door may be hung in the wall system. A three-sided door frame comprises a pair of vertical posts separated by and joined to a horizontal top distance channel. The door frame vertical posts are generally similar to the vertical posts of the panel superstructures. The door frame includes a pair of upper glide assemblies for coupling to a ceiling rail and a glide assembly under each vertical post for adjusting the height of the door frame above the floor. Panel connectors may be mounted in the door frame for interconnection with adjacent wall system components.

To provide a top door pivot, a spring loaded top pin is employed between the top of the door and a bearing in the door frame. A ramped slot in the top pin facilitates forcing the top pin to slide into the door and withdrawing the top pin from the door frame bearing. A bottom door pivot is designed such that the door may be adjustably raised and lowered to suit floor conditions. Further, the bottom door pivot is capable of selectively moving the bottom of the door in a horizontal direction such that the door tends to remain opened or closed. If desired, a narrow door side panel can be installed between the door frame and the adjacent panel. Other than in width, the door side panel is generally similar in construction to full size panels. A transparent or opaque transom above the door can be included in the wall system by providing a shorter door and a center distance channel between the top of the door and the top distance channel.

It is a feature of the present invention that the panels are easily and quickly wired for electrical power and communication purposes. Conduits dropped from the ceiling pass through preformed holes in the superstructure top distance channel and into the space between the opaque coverings. The conduits can terminate in suitable conventional outlets in the covering shells or located in the decorative covers between the floor and the bottom of the superstructure. The vertical posts of the superstructure are also preformed with openings for passing conduits between adjacent panels in a hidden fashion. Because of the non-progressive nature of the wall system of the present invention, power can be supplied or altered to any panel with minimal effect on other panels.

Other features and advantages of the invention will become apparent to those skilled in the art upon reading the disclosure.

BRIEF DESCRIPTION OF THE DRAWINGS

FIG. 1 is a partially broken perspective view of a wall system according to the present invention.

FIG. 2 is a simplified end view of a typical panel according to the present invention.

FIG. 3 is a partially broken front view of a typical panel of the wall system of the present invention, but with some components omitted for clarity.

FIG. 4 is a cross-sectional view taken along lines 4—4 of FIG. 3, but showing some decorative covers in place.

FIG. 10 is an exploded perspective view of the panel connector and upper glide assembly of the present invention.

FIG. 11 is a cross-sectional view of a panel connector in the storage position.

FIG. 15 is a cross-sectional view taken along lines 15—15 of FIG. 3.

DETAILED DESCRIPTION OF THE INVENTION

Figure 5:
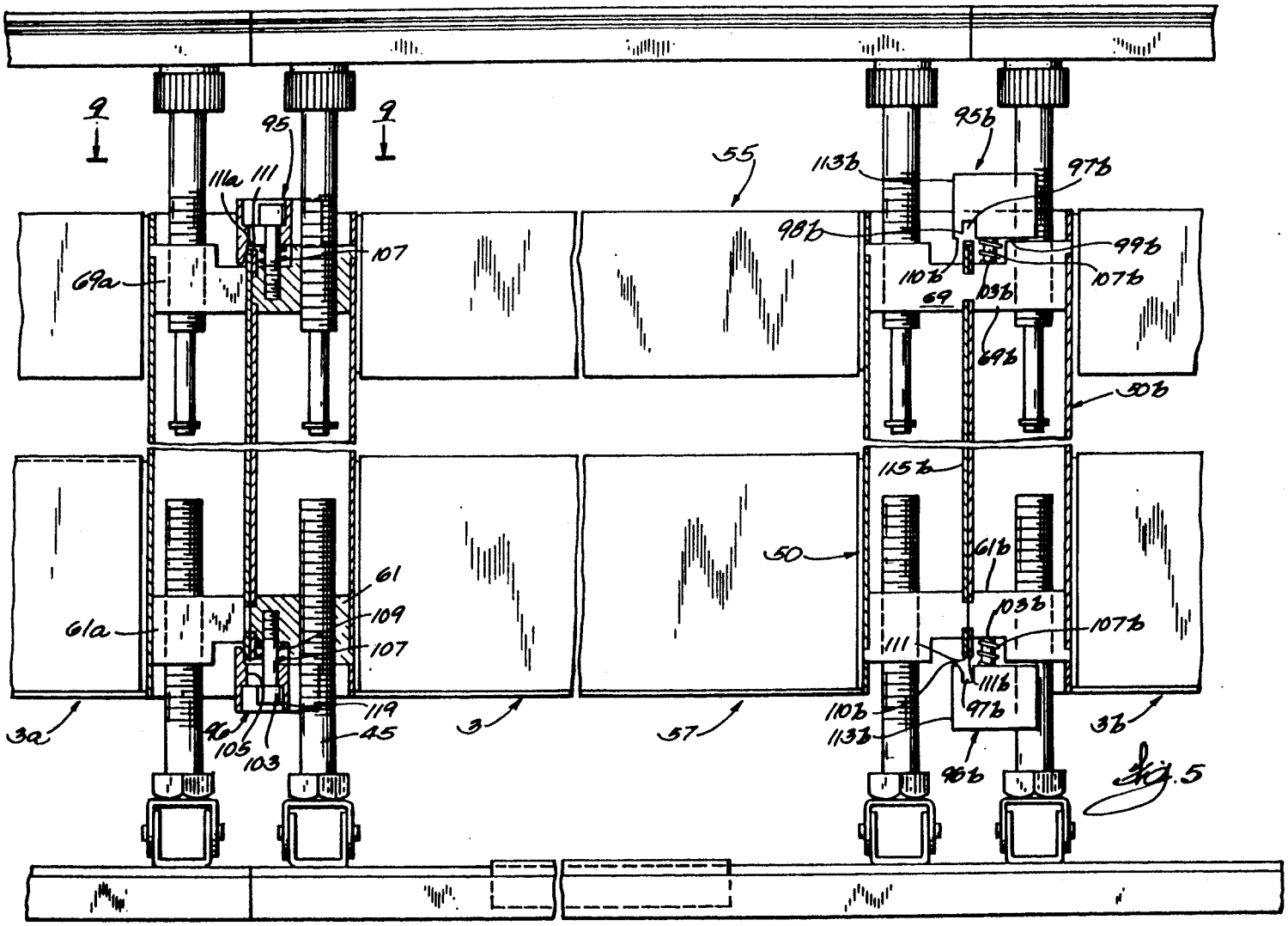
FIG. 5 is a front view, partially in cross-section, of typical panels showing the connection between adjacent panels.

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

General

Referring to FIG. 1, a wall system 1 is illustrated that includes the present invention. The wall system is particularly useful for providing easily alterable enclosures or partitions within a large open area of a building interior.

The wall system 1 is comprised of a number of panels 3. The panels 3 are non-progressive, which means that any panel can be removed from or installed into the wall system independently of the other panels. The panels may have different external appearances. For example, in FIG. 1 the wall system includes several opaque panels 5, three transparent panels 7, and three clerestory panels 331. Nevertheless, all the panels 5, 7, and 331 possess the same basic construction, as will be described in detail hereinafter. The panels may be arranged in a great variety of combinations and patterns to suit the particular needs of the building occupants. In FIG. 1, the wall system is shown with two sets of spaced apart and parallel walls, such as wall 6 composed of panels 3, **3*a* and 3*b* and wall 8 composed of three similar panels. However, the arrangement of panels depicted in FIG. 1** is merely exemplary of a multitude of possible configurations.

Each panel 3 extends between the building floor 9 and the ceiling 11. Also see FIG. 2. It is anticipated that the ceiling 11 will be of the false or drop type of known construction. In FIG. 2, a typical ceiling panel 13 and support angle 15 are shown for illustrative purposes. However, it will be understood that the present invention is completely suitable for use in buildings having other types of ceilings.

Because the panels 3 are non-progressive, they require no support from adjacent panels. Rather, the panels may be retained rigidly in place only by means of secure connections to the floor 9 and ceiling 11.

To combine the features of rigidity and ease of shipping, installation, and removal, the panels 3 are designed such that the major portions thereof are pivotable about a horizontal axis 16. For that purpose, each panel comprises a base assembly 17 that pivotally supports a panel superstructure 19 and other components assembled to the superstructure, as will be explained. Each panel further includes at least one and preferably two upper glide assembly 21 that securely couples the upper end of the panel to the ceiling 11.

Base Assembly

Also looking at FIGS. 3–5, the base assembly 17 of each panel 3 comprises a floor adjustment channel 23 that rests on the floor 9. In the illustrated construction, the floor adjustment channel 23 is formed in transverse cross-section with an inverted U-shaped center portion 25, with symmetrical outwardly extending horizontal plates 27. Each horizontal plate 27 terminates in an upstanding free end 29. The floor adjustment channel horizontal plates may include adjustable carpet grippers 32.

The floor adjustment channel 23 is guided laterally on the floor by one of several generally U-shaped floor rails 31. The floor adjustment channel central portion 25 nests over the floor rail. The floor rails 31 are anchored to the floor by fasteners, not shown, to create the outline for the wall system 1 that partitions a large building space into smaller spaces. The floor rails 31 may be fastened to the floor 9 in a wide variety of patterns to suit almost any partitioning requirement.

Secured to the top of the floor adjustment channel central portion 25 are a pair of bottom pivot clevises 35. A top clevice 37 is pivotally connected to each bottom pivot clevice 35 by respective pins 39. Supported on the center leg 41 of each top clevice 37 is a base glide assembly 43. The base glide assembly 43 is composed of a long glide or screw 45 having a head 47. The screw head 47 is formed with a central hole. A rivet 49 passes through a clearance hole in the top clevice center leg 41 and is tightly fixed in the screw head. The rivet 49 prevents relative axial and lateral movement between the top clevice and the screw, but the screw and rivet can rotate freely about their common longitudinal axis within the top clevice.

Superstructure

In the preferred embodiment, the superstructure 19 is manufactured with a pair of longitudinally spaced vertical posts 50. The longitudinal distance between the vertical posts 50 determines the length of a panel 3 and is equal to or slightly longer than the length of the floor adjustment channel 23.

Figure 9:
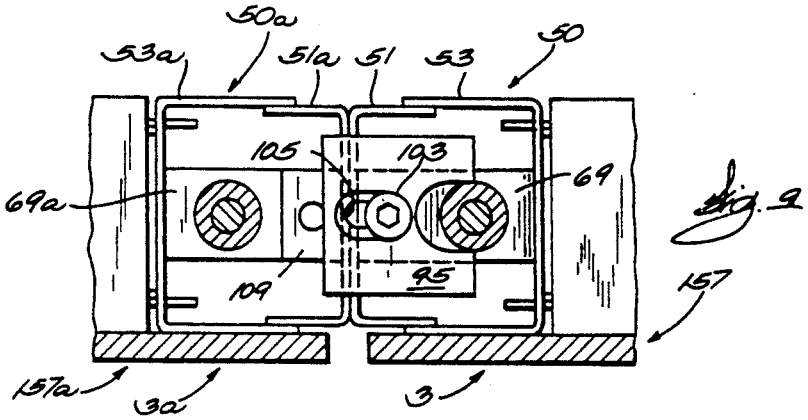
FIG. 9 is a cross-sectional view taken along lines 9—9 of FIG. 5.
Figure 6:
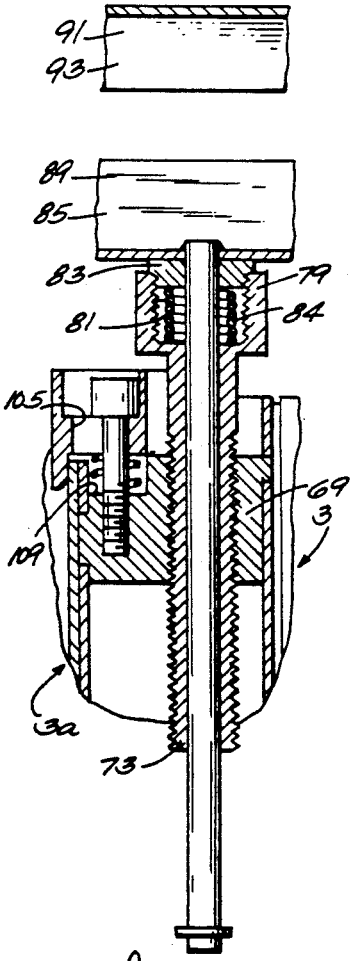
FIG. 6 is a cross-sectional view of a panel connector and an upper glide assembly shown in the uncoupled mode.

Looking for the moment at FIGS. 9 and 10, each vertical post 50 may be composed of a pair of channels 51 and 53 that nest together and are welded to form a rectangular tube. The length of the vertical posts is chosen so as to span most of the height between the floor 9 and the ceiling 11, FIGS. 2–5.

Connecting the vertical posts 50 to each other are a top distance channel assembly 55 and a bottom distance channel assembly 57. The top distance channel assembly 55 comprises an elongated generally U-shaped top distance channel 56 with a top channel hook 58 nesting inside and welded to each end of the top distance channel. At least one pair of hooks 60 on the top channel hook 58 extend beyond the end of the top distance channel 56 and the top channel hook. The hooks 60 engage aligned slots in the respective vertical posts 50 for locating and joining the top distance channel to the posts. The top distance channel 56 has a pair of inturned lips 59 on the free ends of the respective channel side walls 181.

Similarly, the bottom distance channel assembly 57 is comprised of a bottom distance channel 63 and two bottom channel hooks 65. The bottom channel hooks 65 have outturned ledges 66 at the free ends of the channel hook side walls. The bottom distance channel 63 is joined to the vertical posts 50 by hooks 67 on the ends of the bottom channel hooks. The channel hooks 67 engage aligned slots in the vertical posts 50. The top distance channel assembly 55, the bottom distance channel assembly 57, and the vertical posts are securely joined to form a picture-frame superstructure 19.

To support the superstructure 19 on the base assembly 17, a glide block 61 is Welded to the interior of each vertical post 50 near its lower end. Each glide block 61 has a tapped hole for receiving the threads of a base glide assembly screw 45.

Upper Glide Assembly

To releasably couple the panels 3 in the upright attitude, each panel of the wall system 1 includes at least one and preferably two upper glide assemblies 21. In the construction illustrated especially in FIGS. 3–8, one upper glide assembly is mounted in each vertical post 50 of the panels. Each upper glide assembly comprises a glide block 69 welded to the interior of a vertical post near its upper end. The glide block 69 has a tapped hole for engaging the threaded shank 71 of an adjusting barrel 73. The adjusting barrel 73 has a longitudinal passage therethrough for slidingly receiving a rod 75. The lower end of the rod 75 has a retaining ring 77. The adjusting barrel has a knurled head 79 that has a threaded counterbore 81. To the upper end of the rod 75 is rigidly fixed a cap 83. The cap 83 has external threads that are matable with the threads 81 in the adjusting barrel counterbore. A spring 84 is interposed between the cap and the bottom of the adjusting barrel head counterbore. Rigidly joined, as by welding, to the top of the rod is a glide seat 85. The glide seat 85 is generally U-shaped in cross-section with outwardly flaring side legs 89. The glide seat is coupleable with an elongated ceiling rail 91 that is fastened to the ceiling support angle 15 (FIG. 2) by any suitable means. A series of ceiling rails 91 are fastened to the ceiling 11 above the floor rails 31 along the outline of the wall system 1. The ceiling rail 91 has side legs 93 that can nest inside the glide seat legs 89. To reduce noise transmission between the building ceiling and the panels, a gasket 92 is placed between the ceiling rails and the ceiling support angles.

The upper glide assembly 21 releasably couples the panel 3 in the upright attitude by a three step procedure. During the initial process of erecting a panel, the adjusting barrel 73 of each upper glide assembly is partially turned into its glide block 69, FIG. 6. The cap 83 is turned into the adjusting barrel counterbore threads 81, thereby compressing the spring 84. The glide seat 85 is spaced from the ceiling rail 91, allowing the panel to be pivoted about axis 16 to the vertical attitude under the ceiling rail, FIG. 2.

Figure 7:
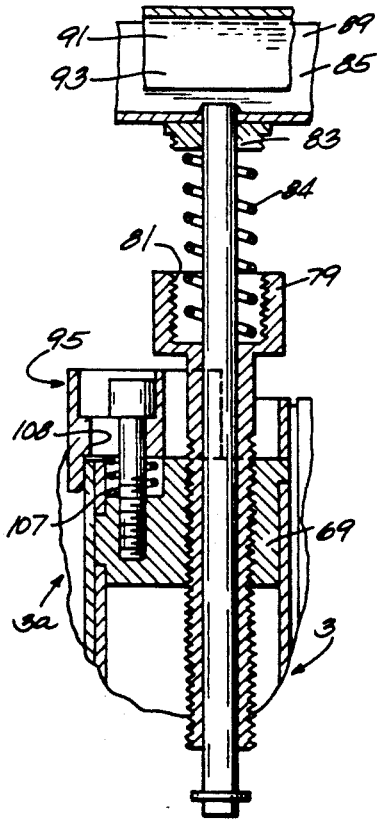
FIG. 7 is a view similar to FIG. 6, but showing the upper glide assembly coupled with a ceiling rail.

Next looking at FIG. 7, the glide seat 85 is held stationary underneath and parallel to the ceiling rail 91. The adjusting barrel head 79 is rotated to translate the adjusting barrel further into the glide block 69 until the cap 83 is unthreaded from the adjusting barrel threads 81. The spring 84 pushes the rod 75, cap, and glide seat upwardly until the glide seat couples with the ceiling rail.

Figure 8:
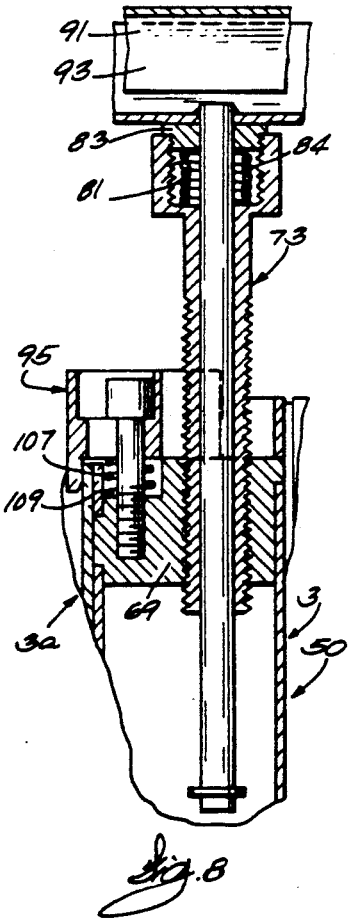
FIG. 8 is a view similar to FIG. 7, but showing the upper glide assembly locked in place against a ceiling rail.

Finally, FIG. 8, the adjusting barrel 73 is turned out of the glide block 69 such that the threads 81 reengage the threads on the cap 83. Additional rotation of the adjusting barrel forces it into compression between the ceiling rail 91 and the panel vertical post 50. As a result, the upper glide assembly 21 couples and locks the panel 3 to the ceiling 11.

If it is desired to remove a panel 3 from the wall system 1, the adjusting barrel 73 is merely turned into the glide block 69 from the location of FIG. 8 until the adjusting barrel unthreads from the cap 83 and the glide seat 85 can be uncoupled from the ceiling rail, FIG. 7. The cap is then rethreaded into the adjusting barrel counterbore threads 81, FIG. 6. The superstructure can then be pivoted about axis 16 (FIG. 2) from the vertical attitude, and the entire panel can then be lifted from the floor rail 31 and removed without disturbing any other panels.

Panel Connectors

To provide increased rigidity between adjacent panels 3, the present invention includes at least one and preferably a pair of panel connectors 95, 96 in one of the vertical posts 50 of each panel. Looking at FIGS. 5–11, each panel connector 95, 96 is formed as a block having a transverse groove 97 formed in a bottom surface 99. The width of the groove 97 is slightly greater than twice the wall thickness of the vertical post channels 51 and 53. The groove preferably has a taper 98 at its intersection With the panel connector bottom surface 99. A step 101 in the bottom surface is sized to enable the panel connector to fit loosely over the glide block 61 or 69. A screw 103 fastens the panel connector to its glide block. The screw 103 passes through a slot 105 that is counterbored on both sides. A spring 107 is placed around the screw 103 between the slot counterbore 108 and a stepped surface 109 in the glide block.

Looking at FIG. 11, a panel connector 95 is shown in a storage position. When the panel connector is in the storage position, a panel 3 or 3*a* can be non-progressively installed within the wall system 1. To attain the storage position, the screw 103 is loosened such that the spring 107 is able to force the panel connector away from the glide block step 109, and the panel connector tip 110 adjacent the groove 97 is at least flush with cutouts 111 in the vertical posts 50. The panel connector is slid to the right with respect to FIG. 11 such that the outside surface 113 is flush or in back of the vertical post outside surface 115. The spring 107 greatly aids in holding the panel connector in place when the screw is loosened. A semi-circular groove 117 in the back side of the panel connector provides clearance for the adjusting barrel 73 when the panel connector is in the storage position. The panel connector 96 at the lower end of the vertical post 50, FIG. 5, is constructed and functions in the same way as the panel connector 95 at the top of the vertical post. In the lower panel connector 96, the semicircular groove 119 provides clearance for the base glide assembly screw 45 when that panel connector is in the storage position.

In FIG. 5, panel connectors 95*b* and 96*b* are shown in a withdrawn position. In the withdrawn position, the panel connectors 95*b* and 96*b* extend beyond the vertical post outside surface 115*b*, and the panel connector groove 97*b* overlies the cutouts 111, 111*b* of the two adjacent vertical posts 50 and 50*b*, respectively. The panel connectors are maintained in the withdrawn position by the springs 107*b*.

From the withdrawn position, tightening the screws 103 draws the panel connector grooves 97*b* to grip the two vertical posts 50, 50*b* to each other, and the panel connectors 95*b* and 96*b* attain the installed positions of the panel connectors 95 and 96 in FIG. 5 and as also shown in FIGS. 6–9. The tapers 98 on the panel connector grooves 97 assist the grooves to grip the vertical posts of the adjacent panels 3 at their respective cutouts 111. With the panel connectors firmly installed, the adjacent panels are rigidly interconnected to each other.

Corner Posts

Referring back to FIG. 1, it will be noticed that the wall system 1 contains four right angle corners, such as corner 121, to create the two sets of spaced apart and parallel walls, such as walls 6 and 8.

The present invention provides two different types of installations for setting the distance between a pair of spaced apart and parallel walls. In a systems or furniture module installation, the nominal distance between spaced parallel walls, such as walls 6 and 8 in FIG. 1, is measured between the inside surfaces of the facing wall panels. For example, if the nominal distance between spaced parallel walls is 12 feet, in a furniture module installation it is the distance between the inside facing surfaces of the panels that is 12 feet. The distance between the spaced walls is set to accommodate various combinations of modular furniture that fit neatly between the two walls so as to maintain the modular nature of the furniture and walls.

Figure 13:
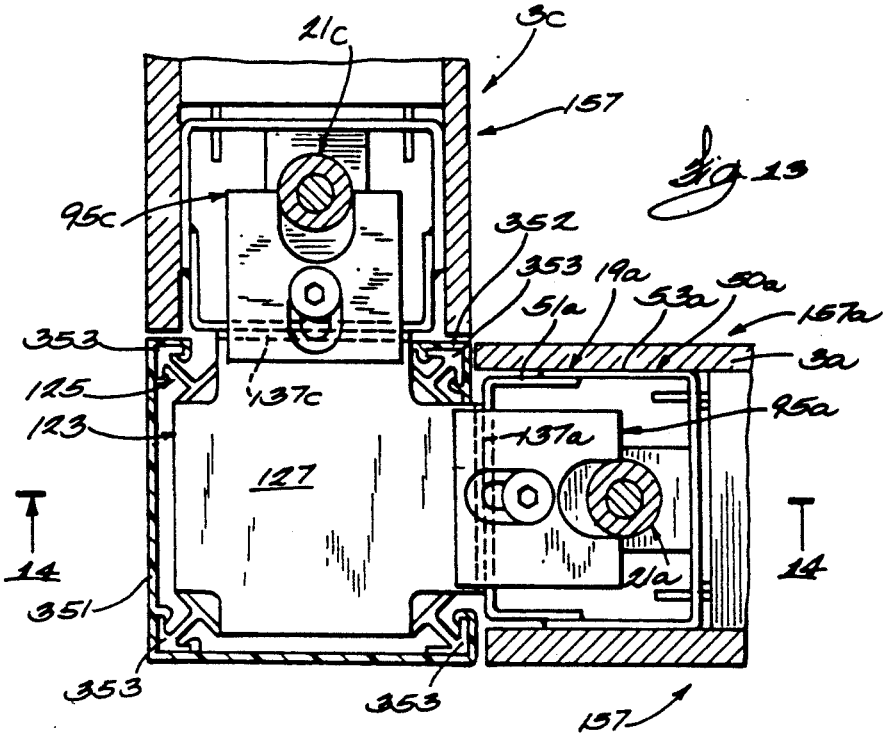
FIG. 13 is a top view, partially in cross-section, of the intersection of two panels according to the present invention arranged in a systems module.
Figure 20:
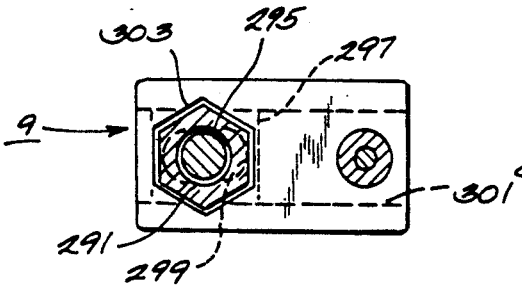
FIG. 20 is a cross-sectional view taken along lines 20—10 of FIG. 19.
Figure 14:
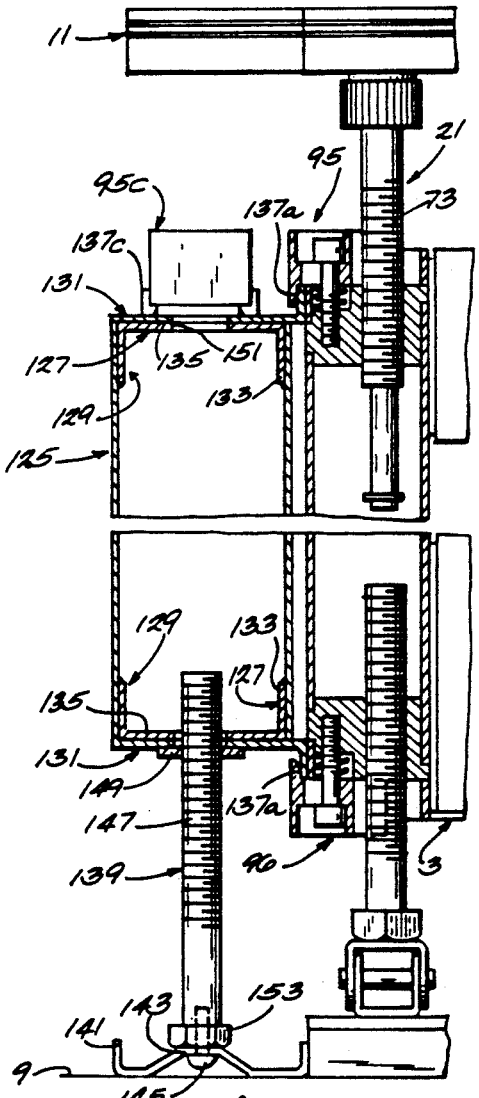
FIG. 14 is a cross-sectional view taken along lines 14—14 of FIG. 13.
Figure 25:
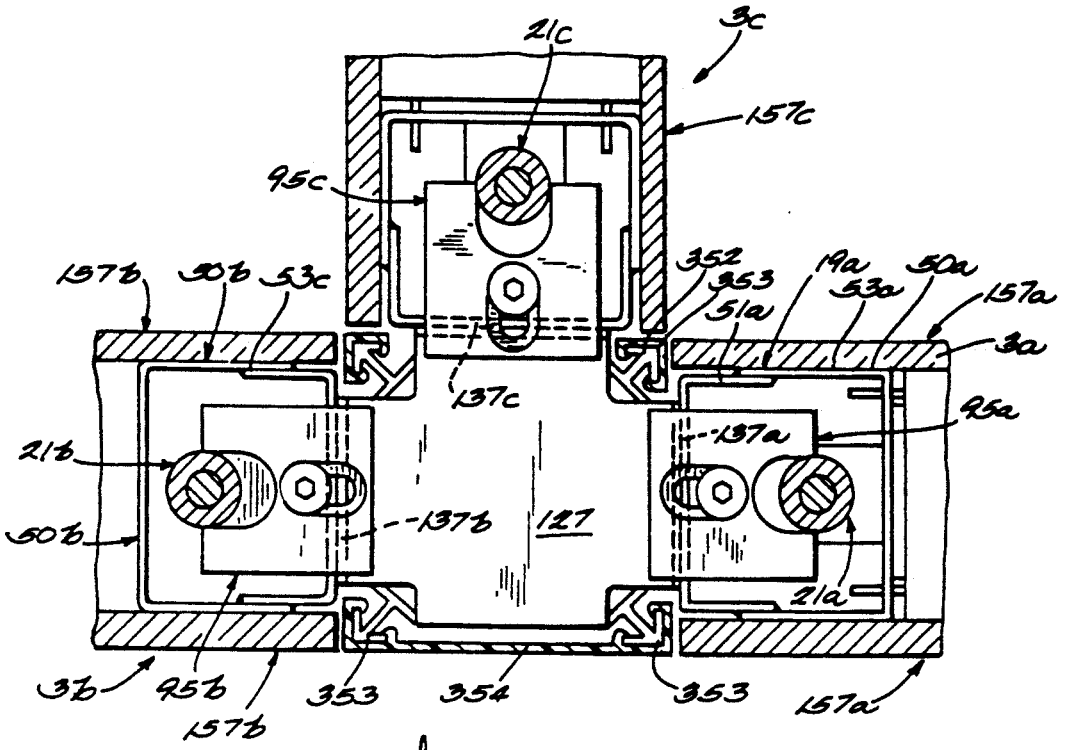
FIG. 25 is a top view similar to FIG. 13, but showing a three-way connection between panels in a furniture module installation.

In the furniture module, rigid connections at non-planar intersections of the various panels 3 are achieved with corner posts that simulate the vertical posts 50 of adjacent coplanar panels. Now turning to FIGS. 13 and 14, a corner post 123 is depicted that is used at corner 121 and at similar corners. The corner post 123 comprises a tube 125 having a height somewhat less than the height of the vertical posts 50 of a panel superstructure 19. A post cap assembly 127 is welded or otherwise secured to both ends of the tube 125. Each post cap assembly 127 is preferably formed of a cap bottom member 129 and a cap top member 131. The cap bottom member 129 has legs 133 that are welded to the interior of the tube 125 and a central plate 135 that is approximately flush with the tube end. The cap top member 131 has an upturned lip 137*a* that simulates the wall material of a superstructure vertical post channel 51 adjacent the channel cutout 111. Also see FIG. 10. Consequently, the panel connectors of an adjacent panel, such as panel connectors 95 and 96 of panel 3 in FIGS. 13 and 14, can grip the respective corner post cap top member lips 137*a* in a manner identical to the gripping of the cutouts 111 of an adjacent panel vertical post 50. Similarly, each post cap top member 131 has at least one additional upturned lip 137*c* that is gripped by panel connector 95*c* of adjacent panel 3*c*. FIGS. 13 and 14 depict a two-way corner post, that is, the corner post connects two panels at right angles to each other. It is possible to provide one or two additional upturned lips 137 in a corner post to thereby enable it to join three or four panels to each other in a three-way or four-way junction. A typical three-way junction for joining three panels 3*a*, 3*b*, and 3*c* is shown in FIG. 25.

To provide leveling for the corner post 125, a glide assembly 139 is a part of every corner post. The corner post glide assembly 139 is comprised of a floor plate 141 that rests on the floor 9 and has a raised boss 143. A rivet 145 turns freely in a hole in the boss 143. The rivet shank is firmly fixed in a central hole in a long base screw or glide 147. The base glide 147 is threaded into a double wing weld nut 149 secured to the corner post cap top member 131, and the base glide passes through clearance holes 151 in the corner post cap top and bottom members. By turning the head 153 of the base glide, the corner post is vertically adjustable to the desired height above the floor.

In the furniture module installation, wall creep is created in the spacings between parallel walls, such as walls 6 and 8. Wall creep is the incremental increase in distance of consecutive parallel walls from a particular starting point. In a furniture module installation, the longitudinal center lines of adjacent parallel walls are not, for example, 12 feet apart; it is the inside surfaces between any two wall panels that are 12 feet apart. Wall creep is created because the corner posts 123 associated with a pair of spaced and parallel walls causes the distance between the longitudinal center lines of the walls to increase by the thickness of a panel. Thus, in a furniture module installation, the walls cannot follow a pre-existing building ceiling grid.

To avoid panel creep in the wall system 1, a second type installation, called the building module installation, is possible for setting the distance between a pair of spaced apart parallel walls. In the building module installation, the distance between spaced parallel walls is set to match a ceiling grid and window mullions, not shown in the drawings, pre-existing in the building. The distance between the parallel walls is set such that their longitudinal center lines coincide with the ceiling grid. For example, in a building module installation having a 12 foot dimension between parallel adjacent grids, it is the longitudinal center lines of the spaced parallel wall panels that are 12 feet apart.

Figure 26:
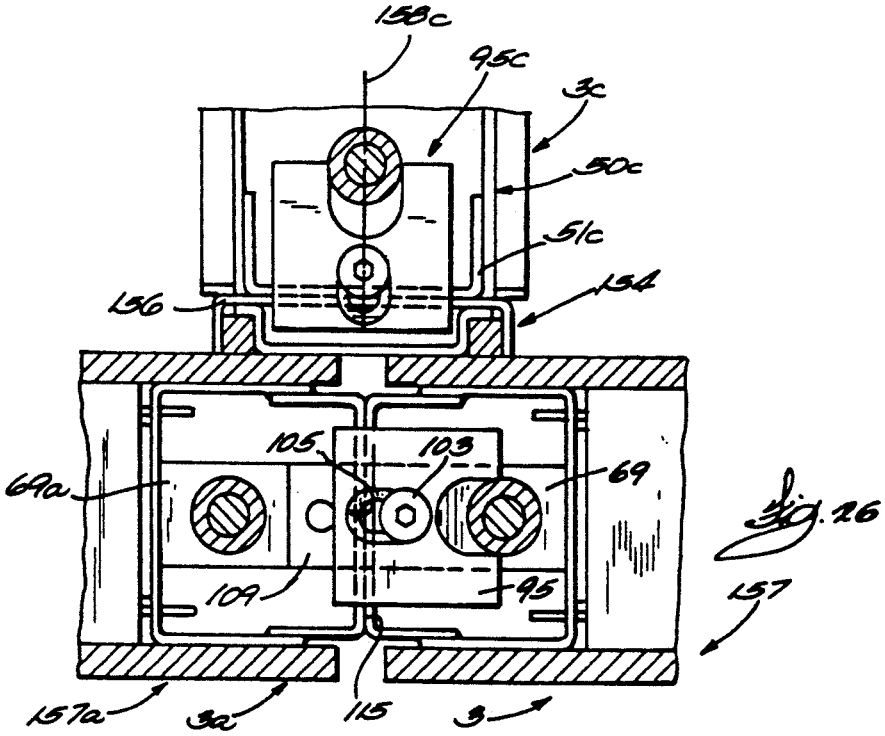
FIG. 26 is a top view similar to FIG. 9, but showing a three-way connection between panels in a building module installation.

To enable the same panels 3 to be used in both furniture and building module installations, intersecting panels are joined directly to each other in the building module installation; corner posts 123 are not used. Looking at FIG. 26, a three-way connection between panels 3, 3*a*, and 3*c* in a building module installation is depicted. The connection includes a bracket 154 that is firmly mounted to the panels 3 and 3*a*. In the illustrated construction, the bracket 154 has a wall 156 that corresponds to a channel 51 of a superstructure vertical post 50. A panel 3*c* is placed perpendicular to the plane of the panels 3 and 3*a* such that the channel 51*c* of the vertical post 50*c* is proximate the bracket wall 156. The longitudinal center line 158*c* of the panel 3*c* coincides with the plane of the surface 115 between the panels 3 and 3*a*. A panel connector 95*c* is used to connect the panel 3*c* to the bracket 154 in a manner previously described with respect to panel connectors 95. In that manner, a series of panels such as panel 3*c* can be erected along a wall of planar panels without introducing creep between their respective center lines 158*c*.

Panel Coverings

Further in accordance with the present invention, the superstructure 19 of each panel 3 can be interchangeably covered and spanned with a variety of materials and components. Again turning back to FIG. 1, the wall system 1 is shown with several opaque panels 5 and transparent panels 7, together with a couple of clerestory panels 331. Both the opaque and the transparent panels utilize the same superstructure. The creation of an opaque panel will be explained in conjunction with FIGS. 3, 4, 12, and 15. Looking first at FIGS. 3 and 12, the top and bottom distance channels 56 and 63, respectively, are fabricated with keyhole slots 155. Similarly, keyhole 155 are formed in the vertical posts 50. The keyhole slots are used to removably receive and hold opaque coverings 157. The coverings 157 may be of almost any desired material and construction. By way of example, the coverings 157 in FIG. 4 comprise partitions 159 sandwiched between pairs of thin shells 161. The outwardly facing shell 161 may be covered with any desired material, such as a decorative fabric, not illustrated. Stiffeners 163 and 165 are placed between the shells 161 at the top and bottom, respectively, of the partition 159. To the shells are fastened a plurality of hooks or buttons 167 by means of screws 169, FIG. 15. If desired, reinforcing plates, not shown in the drawings, can be welded to the shells 161 in the regions of the buttons 167. The buttons are able to enter the wide upper ends of the keyhole slots. As the covering is lowered, the narrower lower ends of the keyhole slots prevent the buttons, and thus the covering, from falling forwardly.

The weight of the coverings 157 is borne by the outturned ledges 66 of the bottom distance channel hooks 65, FIG. 4. Screws 171 passing through the bottom channel hook ledges and the lower stiffener 165 and into the partition 159 provide maximum rigidity between the superstructure 19 and the covering. To provide maximum sound barrier across the panel 5, the partition 159 may be of an acoustical honeycomb construction. Alternately, the space between the two shells 161 of a panel may be filled with insulation 173, FIG. 12, or with a combination of a honeycomb and an insulation material. To remove a covering, it is necessary merely to remove the screws 171 and lift the covering upwardly until the buttons 167 are aligned with the wide upper portions of the keyhole slots 155. The covering can then be pulled horizontally away from the superstructure 19.

Figure 12:
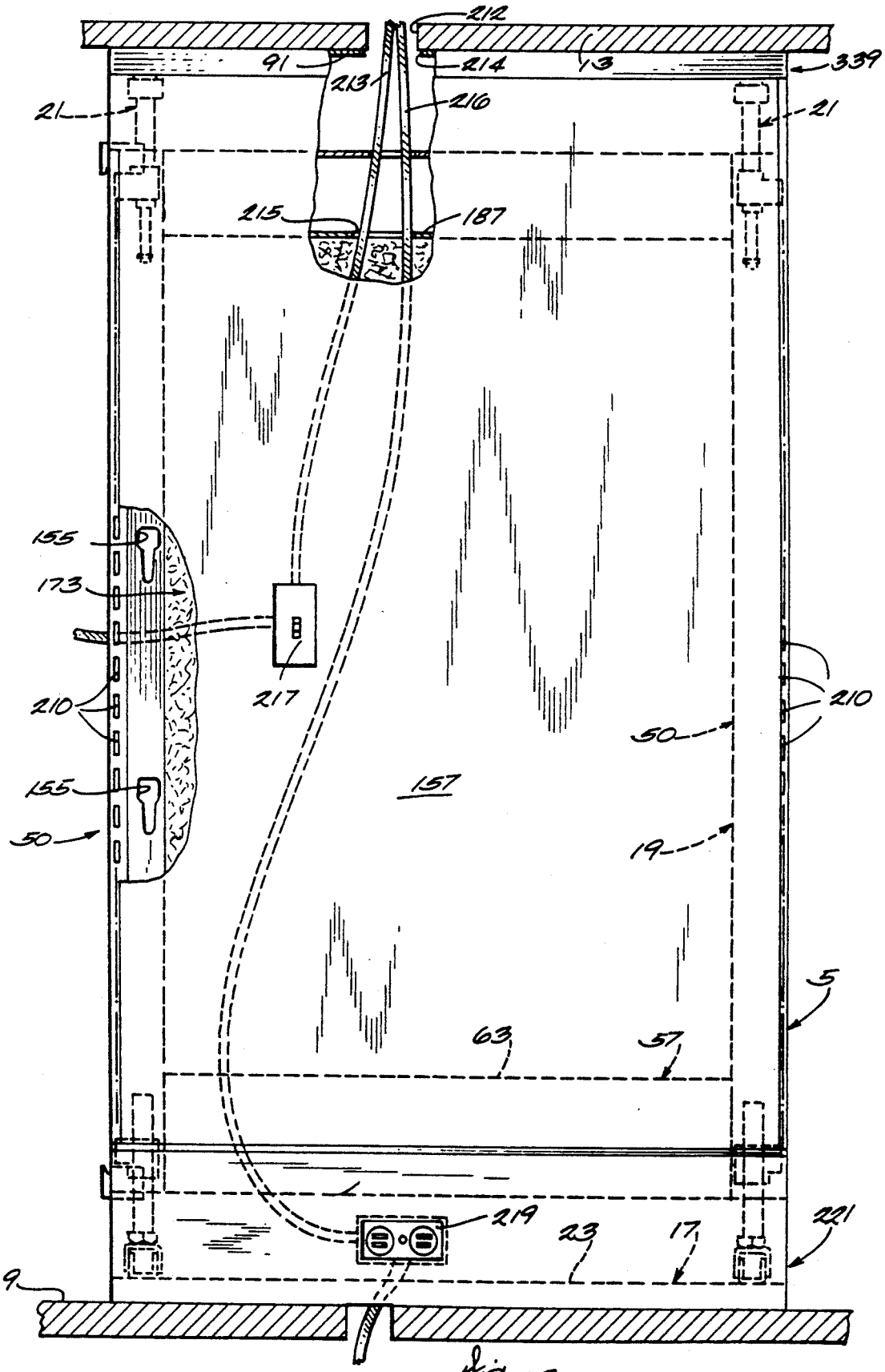
FIG. 12 is a partially broken front view of a panel shown with typical electrical wiring routed therein.

Referring to FIG. 12, it will be noticed that the panel superstructure vertical posts 50 contain a series of vertically aligned slots 210. The slots 210 remain exposed when the coverings 157 are assembled to the panel superstructure 19. The slots 210 are used to receive hooks or tabs of various furniture and accessory modules for hanging them to the wall system 1. Such furniture and other modules are well known in the art and need no additional description.

Figure 16:
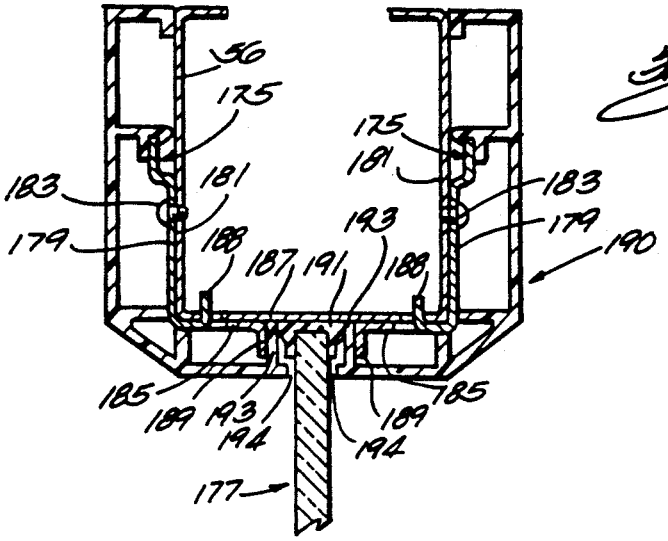
FIG. 16 is a vertical cross-sectional view taken through the top distance channel of a transparent panel.

Now referring to FIGS. 16–18, the construction of the transparent panels 7 will be described. As mentioned, the superstructure 19 for the transparent panels is identical to that for the opaque panels 5. In FIG. 16, a pair of elongated molding clips 175 are used in combination with the top distance channel 56 to enable the top distance channel to accommodate a pane of glass 177. Each molding clip 175 is generally Z-shaped, having a first leg 179 attached to a side wall 181 of the top distance channel 56 by a screw 183, and a second leg 185 partially overlying the central wall 187 of the top distance channel. Additional support for the mounting clip on the top distance channel is provided by several short hooks 188 extending from the second leg 185 thereof and received in suitable cutouts in the top distance channel central wall 187. Third legs 189 on the ends of the molding clip second legs 185 complete the molding clip. A decorative cover 190 is designed to fit over and be retained to each molding clip. The covers 190 include respective legs 193 that lie adjacent respective molding clip third legs 189. The legs 193 on each cover cooperate to define a longitudinally extending space 194. A seal or gasket 191 is placed within the space 194. The seal 191 receives the pane 177 to firmly but gently hold the pane to the upper distance channel.

Figure 17:
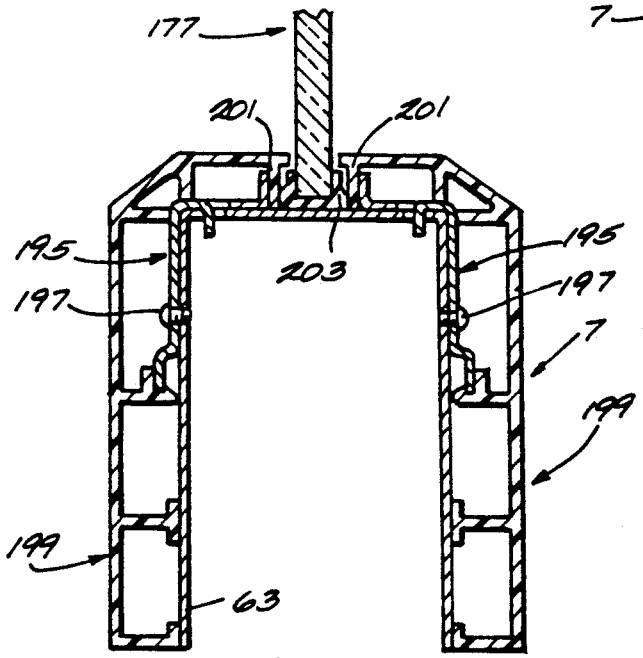
FIG. 17 is a vertical cross-sectional view taken through the bottom distance channel of a transparent panel.

The components for holding the glass pane 177 to the bottom distance channel 63, FIG. 17, are substantially similar to those used with the top distance channel 56. Molding clips 195, which may be identical to the molding clips 175 of FIG. 16, are attached to the bottom distance channel with screws 197. Decorative covers 199 are retained to the bottom distance channel by the clips 195. The decorative covers 199 include respective legs 201 that cooperate to define a longitudinal space into which a seal 203 is placed, together with the glass pane.

Figure 18:
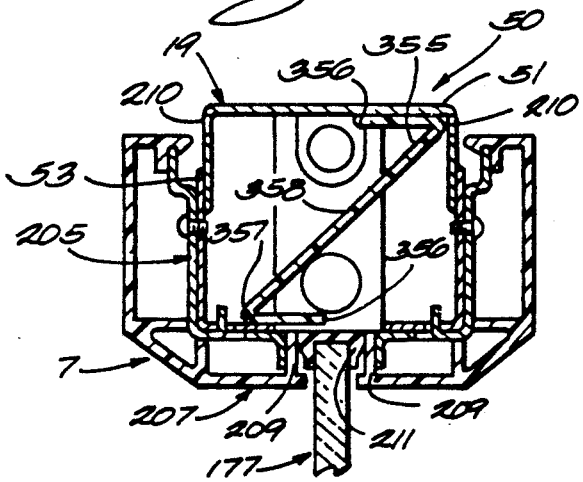
FIG. 18 is a horizontal cross-sectional view taken through a vertical post of a transparent panel.

The components for holding the pane 177 to the vertical posts 50 of a panel superstructure 19 are illustrated in FIG. 18. A pair of Z-shaped molding clips 205 generally similar to the molding clips 175 and 195 described previously are attached to the vertical post channel 53. Each molding clip 205 supports and retains a decorative cover 207 having a leg 209. The legs 209 of the two covers 207 cooperate to define a space into which a seal 211 is placed. The seal 211 in turn receives the pane 177. In that manner, a panel superstructure 19 is assembled with a glass pane in quick and easy fashion.

If it is desired to remodel the wall system 1 at a later date, the transparent panel 7 can easily be converted into an opaque panel 5. The decorative covers 190, 199, and 207 are removed from their respective molding clips 179, 195, and 205. The molding clips are removed from the top distance channel, bottom distance channel, and vertical posts. The seals 191, 203, and 211, together with the pane 177, are removed. The exposed superstructure 19 is then ready for being covered with an opaque covering 157 as described previously with respect to FIGS. 3, 4, 12, and 15. In a similar manner, an opaque panel can be converted into a transparent panel by removing the coverings 154 and installing the molding clips, decorative covers, seals, and pane of FIGS. 16–18.

Wiring

The modular and non-progressive design of the wall system 1 makes it very easy to be furnished with wiring for electrical power and telecommunications. Looking at FIG. 12, an opaque panel 5 is shown wired in a typical manner with electrical power supplied by conduits 213 and 216. The ceiling panel 13 directly above the panel is drilled, as at 212, for the flexible conduits 213 and 216. The ceiling panel hole 212 is aligned with one of several holes 214 prepierced along the length of ceiling rail 91 and between the glide seats 85 of the upper glide assemblies 21 of the panel. Top distance channel central wall 187 is also prepierced with holes 215 through which the conduits 213 and 216 pass into the central region of the superstructure 19. Any conventional electrical switch 217 or similar device can be installed in the covering 157 and connected to the conduit 213.

Similarly, the bottom distance channel 63 is prepierced with holes to enable the conduit 216 to pass therethrough to the space between the superstructur bottom distance channel and the base assembly 17. A conventional electrical outlet 219 or other device can be connected to the conduit 216 and installed in a base cover 221, to be described presently, that spans the space between the bottom of the covering 157 and the floor 9. Further, the vertical posts 50 are prepierced with holes that provide passages for conduits between adjacent panels, not illustrated in FIG. 12. It will be appreciated, of course, that a wide variety of electrical service and telecommunication configurations are possible with each panel, but all configurations can be wired without any drilling being required in the panels for the conduits; only the ceiling panel 13 requires any drilling at panel installation. Moreover, if desired the power and telecommunication conduits can be supplied from the floor 9. In that case, suitable holes need be drilled only in the floor; the conduits such as conduit 222, pass through prepierced holes in the floor adjustment channels 23 and in the bottom distance channel assemblies 57.

Door Module

It is a feature of the present invention that the wall system 1 includes a non-progressive door module 223, FIGS. 1 and 19–21. The door module 223 comprises a three-sided door frame 225 that is sized to suit a door 227. The door 227 and door frame 225 are typically narrower than a full width panel 3. To accommodate the door module in the wall system, a narrow door side panel 229 is includable in the wall system adjacent the door frame. The narrow door side panel 229 is very similar to the full Width panel 3, with the only significant difference being that the superstructure of the door side panel has shorter top and bottom distance channels **56*d* and 63*d*, respectively. In all other respects, the door side panel is a non-progressive panel that has the same features and advantages of the full sized panels 3. The door side panel may be either opaque or transparent, as described previously in connection with panels 5 and 7**.

The door frame 225 is comprised of a pair of vertical posts 231 and 232 that are substantially similar to the vertical posts 50 of the panels 3. The door frame includes a top distance channel assembly 233 that is composed of a relatively short top distance channel 235 and channel hooks 237 welded to both ends of the top distance channel 235. The channel hooks 237 have respective hooks 239 that engage aligned slots in the posts 231 and 232 in a manner analogous to the joining of the distance channels 56 and 63 to the vertical posts 50 in the panel superstructure 19 as described previously.

To support the door frame 225 on the floor 9, two different glide assemblies are employed. A first frame glide assembly 241 supports the door frame post 231 adjacent the door hinge side 243. The first frame glide assembly 241 comprises a long screw or glide 245 having threads received in a glide block 247. The glide block 247 is welded to the door frame post 231 in a manner substantially identical to that of the glide blocks 61 and 69 described in conjunction with the superstructure 19 of FIGS. 4 and 5. The glide 245 has a knurled head 249 and a hub 251 that is supported on a floor pivot plate 253. The floor pivot plate 253 rests on and may be attached to the floor. A rivet 255 passing through the floor pivot plate 253 and tightly fixed in the glide permits the glide to be rotated to adjust the height of the door frame above the floor but prevents any lateral movement of the glide. Clearance for the rivet head is provided by a groove 301 in the floor pivot plate.

A second door frame glide assembly 257 supports the door frame post 232 adjacent the door latch side 259. The second door frame glide assembly 257 comprises a long screw or glide 261 threaded into a glide block 263 welded to the door frame post 232. A hub 265 on the end of the glide 261 rests on a strike bottom 267. In the illustrated construction, the strike bottom 267 is fabricated as a flat cylinder portion 268 having at least three downward projections 269 for supporting the cylinder portion 268 above the floor 9. The projections 269 serve as carpet grippers to prevent lateral movement of the strike bottom. When installed over a tile floor 9, an entirely cylindrical strike bottom that lacks any downward projections, not illustrated, is normally employed. A rivet 271 rotatably received in the strike bottom and fixed in the glide prevents lateral movement of the glide but permits vertical adjustment of the door frame post 232 by rotating the glide by means of the hex head glide head 273. Upper glide assemblies 21 are used to couple the top of the door frame to the ceiling 11 in a manner previously described in conjunction with FIGS. 4–10.

The door frame 225 may be rigidly interconnected to adjacent components of the wall system 1 by panel connectors 275 and 277. Panel connector 277 is shown mounted to glide block **61*d* on the adjacent door side panel 229. The panel connector 275 is shown mounted to the glide blocks 247. Additional panel connectors are employed at the tops of the door frame posts 231 and 232. The construction and function of panel connectors 275 and 277 are identical to that of the panel connectors 95 and 96 described previously with respect to FIGS. 5 and 9–11**.

Figure 19:
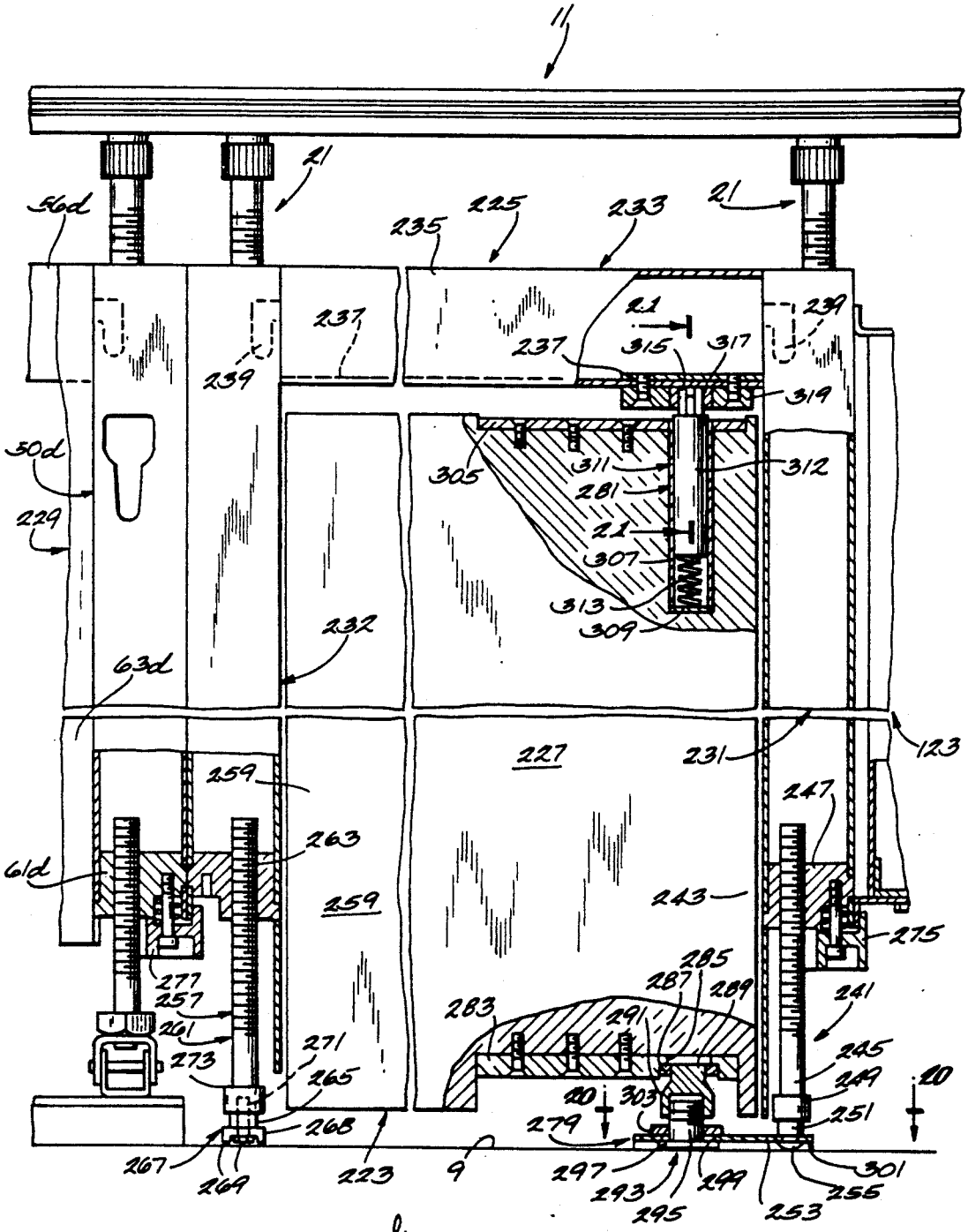
FIG. 19 is a front view, partially in vertical cross-section, of the door module of the present invention.

It will be recognized from FIG. 19 that the panel connector 277 may be mounted to the door frame glide block 263, if desired, rather than to the door side panel vertical post **50*d*. It is anticipated that the panel connectors, such as at reference numeral 275, will be mounted to the door frame post 231 when a corner post 123 is installed in the wall system 1 adjacent a door module 223, as is illustrated in FIG. 19**.

In FIG. 19, the door frame 225 is shown interconnected with a door side panel 229 on the door latch side 259 and with a corner post 123 on the door hinge side 243. It will be appreciated that the door side panel may be on the hinge side 243 of the door. Further, the door frame post 231 or 232 on the side opposite the door side panel may be interconnected with a panel 3 rather than a corner post 123. The interchangeability of the various components renders the wall system of the present invention very versatile for solving changing partition requirements.

The door 227 is swingingly mounted within the door frame 225 by a bottom pivot holder assembly 279 and a top pivot holder assembly 281. Considering the bottom pivot hold assembly 279 first, the bottom edge of the door is recessed to receive a plate 283. The plate 283 has a hole 285 with a counterbore, into which is pressed a conventional cage type bearing 287. The bearing 287 fits over a shaft portion 289 of a pivot nut 291. The pivot 291 is threaded onto a pivot bolt assembly 293. The pivot bolt assembly 293 is composed of a threaded bolt 295 welded to a rectangular plate 297. The bolt 295 passes through a slot 299 in the floor plate 253. The floor plate groove 301 is sized to receive the rectangular plate 297 and prevent it from turning relative to the floor plate. A lock nut 303 is also threaded over the bolt 295. By turning the pivot nut 291 by means of flats thereon, the door height above the floor 9 can be adjusted.

Top pivot holder assembly 281 comprises a plate 305 recessed into the top edge of the door 227. Welded to the plate 305 is a hollow pivot holder 307 that includes an end cap 309. Preferably, the pivot holder 307 is a rectangular tube. Inserted in the pivot holder is a top pivot pin 311. The top pivot pin 311 has a shank 312 with a rectangular cross-section sized to slide within the hollow pivot holder. The top pivot pin is biased upwardly out of the pivot holder by a spring 313. The top end of the top pivot pin is formed with a cylindrical hub 315 that fits within a bushing 317. The bushing 317 is pressed into a plate 319 that in turn is fastened to the door frame top distance channel 235. Thus, it is seen that the door swings about the pivot nut 291 of the bottom pivot holder assembly 279 and the top pivot pin 311. Door knob and strike plate hardware are used to keep the door closed and locked when desired.

The design of the bottom pivot holder assembly 279 is unique in that it enables the door 227 to be tilted within the plane of the door frame 225. Such tilting is desirable because it enables the door to be biased by gravity to either an open or a closed position. Door tilting is accomplished by loosening the lock nut 303 on the bolt 295 and sliding the pivot bolt assembly 293 within the slot 299 and the groove 301 in the floor plate 253. At the location of the pivot bolt assembly that gives the desired bias of the door, the lock nut is retightened against the floor plate. It will be noticed that the door height adjustment provided by the bolt 295 and the pivot nut 291 is independent of the tilting adjustment provided by the sliding of the pivot bolt assembly within the floor plate 253.

Figure 21:
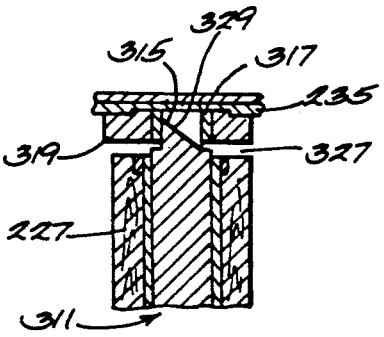
FIG. 21 is a cross-sectional view taken along lines 21—21 of FIG. 19.
Figure 22:
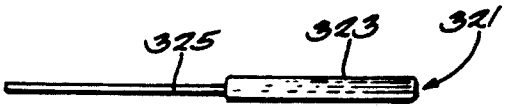
FIG. 22 is a front view of a tool that is useful for removing the door from the door module of the present invention.

A further feature of the door module 223 is the structure for installing and removing the door 227 from the door frame 225. Looking also at FIG. 22, a tool 321 having a handle 323 and a long rod 325 is depicted. The tool rod 325 is dimensioned to fit in the space 327 between the top edge of the door and the plate 319 and bushing 317. As best shown in FIG. 21, the hub 315 of the top pivot pin 311 is machined with a ramped slot 329.

In use, a person grasps the tool 321 by the handle 323 and inserts the rod 325 into the space 327 and against the slot ramp 329. By inserting the tool on the slot ramp, the top pivot pin 311 is forced downwardly against the spring 313 until the top pivot pin hub 315 is removed from the bushing 317. Then a slight tipping of the door 227 on the pivot nut 291 of the bottom pivot holder assembly 279 enables the top of the door to clear the door frame top distance channel 235 and be lifted off the pivot nut. In that manner, the door is easily and quickly assembleable and removable from the door frame 225.

Transom and Clerestory

Turning back to FIG. 1, a pair of clerestory panels 331 having relatively small window panes 333 are illustrated. The clerestory panels 331 are comprised of a superstructure generally similar to the superstructure 19 described previously with respect to the opaque and transparent panels 5 and 7, respectively. However, the clerestory panels have center distance channels 335 extending between the superstructure posts 50 at a desired height above the floor 9 and between the normal top distance channel 56 and the bottom distance channel 63. The center distance channels 335 have keyhole slots 155 for hanging the coverings 157. The various components, such as molding clips 175, 195, and 205 and covers 190, 199, and 207, described in conjunction With FIGS. 16–18, but modified to the correct lengths, are used to hold the glass panes 333 in place on the clerestory panels.

Although not shown in the drawings, the door module 223 may include a transom. For the purpose, the door 227 is shortened a desired amount. A center distance channel similar to the center distance channel 335 of the clerestory panel 331 is provided between the door frame posts 231 and 232 at the proper distance above the door top. The space between the door frame center distance channel and the top distance channel 235 may be spanned with a window pane similar to pane 333 of the clerestory panel 331 or with an opaque covering 157, as desired.

Covers and Gaskets

To provide a neat appearance for the wall system 1, the various working components of the panels 3 are generally hidden with attractive covers. Looking especially at FIGS. 4 and 12, the base glide assemblies 43 are covered with longitudinally extending base covers 221. The base covers snap into place by cooperating with the upturned ends 29 of the floor channel 23 and with a cover clip 339 that is fixed to the center portion 25 of the floor channel. The base covers 221 overlap the lower ends of the panel coverings 157, or the transparent panel decorative covers 199, FIG. 17, to thereby enable the superstructure height to be adjusted without affecting the base covers.

The upper glide assemblies 21 are covered with a pair of ceiling cover assemblies 340. Each ceiling cover assembly 340 comprises a top ceiling cover 341 and a bottom ceiling cover 343. The top ceiling cover 341 is slidingly nestable within the bottom ceiling cover 343. The bottom ceiling covers are retained to the inturned top distance channel lips 59 by a ceiling cover holder 345. The top ceiling covers are retained to a clip 347. The clip 347 in turn is captured to the upper glide assembly guide seats 85 by means of tabs 349. The clip has holes through which pass the caps 83. Because of the slidingly nestable feature of the top and bottom ceiling covers, those covers automatically accommodate variations in distance between the ceiling 11 and the top of the panel superstructure 19.

Looking at FIG. 13, a generally L-shaped longitudinal cover 351 covers the exterior surface of the corner post 123. In the illustrated embodiment, the cover 351 is retained by clipping onto generally arrowhead-shaped protrusions 353 formed on the tube 125. An inside cover 352 clips onto another arrowhead-shaped protrusion 353 to create a neat corner at the joint between the coverings 157 on the insides of the panels 3*a* and 3*c*. With a three-way junction, FIG. 25, a flat cover 354 is used in place of the L-shaped cover 351, and two inside covers 352 are required.

As mentioned previously, the panel superstructure vertical posts 50 are fabricated with vertically aligned slots 210, FIG. 12. Those slots are also shown in FIG. 18, which relates to a transparent panel 7, since the superstructure vertical posts are identical for both transparent and opaque panels 5 and 7, respectively. The slots 210 permit light to pass through a panel 3. To block all light from passing through the panel by means of the slots 210, a privacy or light cover 355 is inserted into the interior of the panel vertical posts. In the illustrated construction, the privacy cover 355 is generally Z-shaped, having two side legs 356 connected by respective resilient joints 357 to a center leg 358. The privacy cover 355 blocks all light that would otherwise pass through the panel superstructure posts via the slots 210.

Other decorative covers are also used with the wall system 1. For example, right angle covers are used at the base and top of the corner posts 123. The right angle covers connect with the base covers 221 and ceiling covers 341 and 343, FIG. 4. Other covers, which are generally similar to the covers 207 used with the transparent panels 7, FIG. 18, are used to cover the vertical posts 231 and 232 of the door frame 229, FIG. 19.

Figure 24:
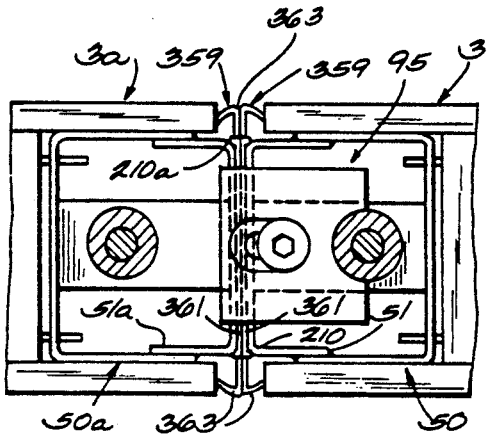
FIG. 24 is a top view, partially in cross-section, of FIG. 23.
Figure 23:
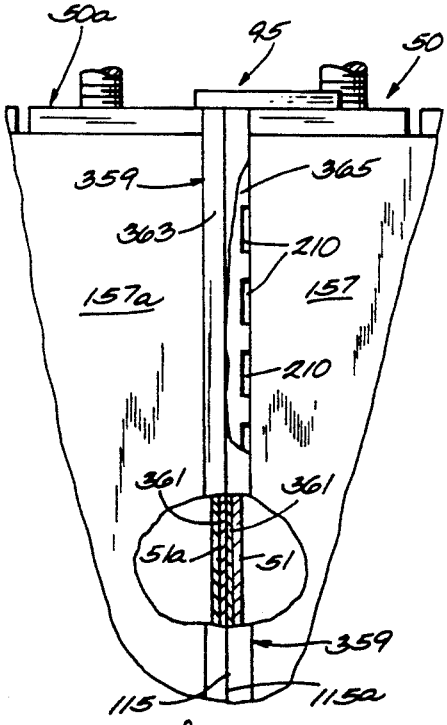
FIG. 23 is a partially broken front view of a portion of a typical connection between adjacent panels with panel gaskets in place.

Now turning to FIGS. 23 and 24, a preferred joint between adjacent panels 3 and 3*a* will be described. In the preferred construction of the wall system 1, a pair of identical gaskets 359 are interposed in the vertical joint between the outside surfaces 115, 115*a* of adjacent panels 3, 3*a*. That is, the gaskets 359 are sandwiched between the vertical posts 50, 50*a* of adjacent panels. Each gasket is made of a dual durometer material. The gasket has a flat center strip 361 of a relatively high hardness. The center strip 361 is very thin, having a thickness on the order of approximately 0.03 inches. The grooves 97 of the panel connectors, such as panel connector 95, are able to accommodate the thin gasket center strips without difficulty when the panel connectors are installed to grip the cutouts 111, 111*a* in adjacent post channels 51 and 51*a*. Also see FIGS. 5 and 10. Wings 363 on the gaskets 359 overlie the slots 210, 210*a* in the vertical posts 50, 50*a* that are left exposed by the opaque panel coverings 157 and the transparent panel covers 207 (FIG. 18). The gasket wings 363 are made of a low durometer material, so they are able to compress and flex to compensate for any unevenness or out-of-parallel condition of the covering edges relative to the superstructure posts. Further, the soft wing material permits them to be easily bent back from the covering edge, as at reference numeral 365, to expose the slots 210. With the gasket wings bent back, hangable furniture modules and other office accessories, not illustrated in FIGS. 23 and 24, may be hung by means of the slots 210. With the furniture in place, releasing the gasket wings causes them to resiliently return toward their normal configuration and hide the slots and the junctions between the modular furniture components and the panel vertical posts. Referring once again to FIG. 26, a pair of gaskets 359 are also used between the panels 3 and 3*a* in a three-way junction of a building module installation. However, for clarity, the gaskets are not shown in FIG. 26.

The various covers and gaskets are preferably made of a decorative synthetic material. Molded rigid polyvinylchloride material works very well. For safety purposes, the material may have an Underwriters Laboratory rating, such as UL 94-VO.

Thus, it is apparent that there has been provided, in accordance with the invention, a wall system that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. A wall system for partitioning a relatively large space having a floor and a ceiling into smaller spaces comprising:

a means on the building floor for defining the outline of the wall system;

b. positioning means for defining the location of the top of the wall system fastened to the ceiling vertically above the outline defining means; and c. a plurality of panels arranged in at least one vertical plane between the floor and the positioning means, each panel comprising:

i. a base assembly supported on the floor and comprising a horizontal pivot axis;

ii. a superstructure pivotally supported on the base assembly for pivoting about said horizontal axis into a vertical plane;

iii. covering means removably attached to the superstructure for creating a vertical partition; and iv. vertically extendable and retractable means for releasably coupling the panel to the positioning means.

2. The wall system of claim 1 wherein the base assembly comprises:

a. an elongated floor channel placed on the floor;

b. at least one base glide assembly connected to the superstructure; and c. clevice means for pivotally supporting the base glide assembly on the floor channel, so that the clevice means enables the base glide assembly and the superstructure to pivot relative to the floor channel.

3. The wall system of claim 2 wherein the base glide assembly comprises:

a. an elongated screw supported on the clevice means and having threads that mate with the superstructure; and b. rivet means for rotatingly mounting the screw to the clevice means, so that the height of the superstructure can be adjusted relative to the floor by rotating the screw.

4. The wall system of claim 3 wherein the base assembly further comprises:

a. at least one first clevice secured to the floor adjustment channel, and, b. a second clevice mounted to the first clevice for rotating about a horizontal axis;

c. an elongated screw having a head supported by the second clevice and threads that mate with the superstructure; and d. rivet means for rotatingly mounting the screw to the second clevice, so that the second clevice, screw, rivet means, and superstructure means are pivotable about the first clevice and the floor adjustment channel.

5. The wall system of claim 2 further comprising:

a. base cover means extending between the covering means and the floor for covering the base assembly; and b. cover clip means fixed to the floor channel for cooperating with the floor channel to hold the base covering means in place on the panel.

6. The wall system of claim 1 wherein the panel superstructure comprises:

a. a pair of vertical posts;

b. top distance channel means for joining the upper ends of the vertical posts at a predetermined spacing therebetween;

c. bottom distance channel means for joining the bottom ends of the vertical posts at a predetermined spacing therebetween; and d. glide block means secured to the vertical posts for connecting to the base assembly, so that the vertical posts and top distance channel means and bottom distance channel means cooperate to form a superstructure that is pivotable about the base assembly means.

7. The wall system of claim 6 wherein the top distance channel means comprises:

a. a generally U-shaped channel of predetermined length; and b. a pair of generally U-shaped channel hooks, a channel hook nesting within and being fixed to a respective end of the U-shaped channel, each channel hook being formed with at least one hook that engages the associated vertical post to thereby join the top distance channel to the vertical post.

8. The wall system of claim 6 wherein:

a. the bottom distance channel means is formed with at least one outwardly extending ledge; and b. the covering means comprises an opaque covering supported on the bottom distance channel means ledge and is removably assembled to and spans the superstructure.

9. The wall system of claim 6 wherein the covering means comprises:

a. first cover means attached to the top distance channel means for defining a first longitudinally extending space;

b. second cover means attached to the bottom distance channel means for defining a second longitudinally extending space;

c. third cover means attached to the vertical posts for defining respective third longitudinally extending spaces therealong;

d. seal means placed in the first, second, and third longitudinally extending spaces on the top distance channel means, bottom distance channel means, and vertical posts, respectively; and e. a pane of glass received in the seal means and spanning the superstructure to thereby create a transparent panel.

10. The wall system of claim 9 wherein:

a. the first cover means comprises a pair of first elongated molding clips attached to the superstructure top distance channel means and a pair of first decorative covers retained to the respective first molding clips, the first decorative covers having respective legs that are spaced apart to create the first longitudinally extending space;

b. the second cover means comprises a pair of second elongated molding clips attached to the bottom distance channel means and a pair of second decorative covers retained to the respective second molding clips, the second decorative covers having respective legs that are spaced apart to create the second longitudinally extending space; and c. a pair of third elongated molding clips attached to each of the superstructure vertical posts and a pair of third decorative covers retained to the respective third molding clips on each vertical post, the pair of third decorative covers on each vertical post having respective legs that are spaced apart to create the longitudinally extending spaces on the vertical posts.

11. The wall system of claim 6 wherein the upper glide assembly comprises:

a. a glide block fixed to at least one superstructure vertical post adjacent the top distance channel;

b. an adjusting barrel having first threads threaded into the glide block and second threads;
c. rod means slidably received in the adjusting barrel and having threads for selectively mating with the second threads of the adjusting barrel;
d. a glide seat joined to the rod means and configured to couple with the ceiling rail means; and
e. means for biasing the rod means and glide seat away from the adjusting barrel and into coupling with the ceiling rail means, so that the adjusting barrel and glide seat are selectively adjustable relative to the panel superstructure and to the ceiling rail means.

12. The wall system of claim 6 wherein:
a. The vertical posts of each panel have respective outside surfaces with a selected outside surface of a first panel vertical post being generally coplanar with a selected outside surface of an adjacent second panel vertical post when the first and second panels are arranged in a vertical plane;
b. a third panel having a longitudinal center line is arranged generally perpendicular to the first and second panels with the third panel longitudinal center line being generally coincident with the plane of the selected outside surfaces of the vertical posts of the first and second panels;
c. a bracket is mounted to at least one of the first and second panels proximate the coplanar selected outside surfaces of the vertical posts thereof; and
d. panel connector means is mounted to the third panel for releasably gripping the bracket, so that third panels can be installed at generally right angles to the vertical plane of panels with the longitudinal center lines of the respective third panels being generally coincident with the respective selected coplanar end surfaces of the panels in the vertical plane thereof.

13. The wall system of claim 6 further comprising gasket means interposed between the vertical posts of adjacent panel superstructures for overlying a portion of at least one of the vertical posts.

14. The wall system of claim 6 wherein:
a. the panel superstructure further comprises center distance channel means extending between and joined to the vertical posts at a predetermined location below the top distance channel means; and
b. the covering means comprises:
   i. an opaque covering assembled to and spanning the superstructure between the vertical posts and the bottom and center distance channel means; and
   ii. a transparent covering assembled to and spanning the superstructure between the vertical posts and the top and center distance channel means, the transparent covering comprising first decorative cover means attached to the top distance channel means for defining a first longitudinally extending space, second decorative cover means attached to the center distance channel for defining a second longitudinally extending space, third decorative cover means attached to the vertical posts between the top and center distance channel means for defining respective third longitudinally extending spaces therealong, seal means placed in the first, second, and third longitudinally extending spaces, and a pane of glass received in the seal means and spanning the superstructure between the vertical posts and the top and center distance channel means to thereby create a clerestory panel.

15. The wall system of claim 1 further comprising panel connector means mounted to a selected panel for releasably gripping an adjacent panel to thereby rigidly interconnect the selected and adjacent panels to each other.

16. The wall system of claim 15 further comprising:
a. at least one block fixed to a selected vertical post of a first panel; and
b. a panel connector mounted to the block, the panel connector being selectively positionable on the block between an installed position whereat the panel connector grips the vertical posts of the first panel and of a second panel adjacent the first panel to interconnect the first and second panels to each other and a withdrawn position whereat the panel connector releases the first and second panel vertical posts from each other.

17. The wall system of claim 16 wherein:
a. the panel vertical posts are formed as generally rectangular tubes; and
b. the panel connector is fabricated with a groove sized to grip the adjacent walls of the vertical post tubes of the first and second panels when the panel connector is in the installed position.

18. The wall system of claim 17 wherein:
a. the panel superstructure vertical post tubes are formed with a plurality of vertically aligned slots in opposite walls thereof; and
b. the panel superstructure further comprises a privacy cover inserted into the vertical posts for blocking light transmission through the vertical post slots.

19. The wall system of claim 16 wherein:
a. the vertical posts of the first and second panels have respective outside surfaces;
b. the panel connector has an outside surface that extends beyond the first panel vertical post outside surface when the panel connector is in the installed and withdrawn positions; and
c. the panel connector is selectively positionable to a storage position whereat the panel connector outside surface is generally flush with the first panel vertical post outside surface.

20. The wall system of claim 15 wherein the panel connector means comprises:
a. at least one block fixed to a vertical post of a selected panel;
b. a panel connector having a slot and a groove therein;
c. fastener means passing through the panel connector slot for slidingly mounting the panel connector to the block, the panel connector being slidable between a storage position whereat the panel connector groove is remote from the adjacent panel and a withdrawn position whereat the panel connector groove is proximate and grippable with the adjacent panel to enable selectively drawing the panel connector from the withdrawn position into an installed position whereat the panel connector groove grips cooperative portions of the selected and adjacent panels to thereby interconnect the selected and adjacent panels to each other; and
d. spring means for biasing the panel connector from the installed to the withdrawn positions.

21. The wall system of claim 15 further comprising at least one gasket interposed between the selected and adjacent panels, the gasket being gripped by the panel connector means when the panel connector means interconnects the selected and adjacent panels to each other.

22. The wall system of claim 1 wherein the upper glide assembly means comprises:

a. at least one glide block fixed to the superstructure;
b. an adjusting barrel threaded into the glide block;
c. glide seat means slidingly received in the adjsuting barrel for releasably coupling to the ceiling rail means; and
d. spring means for biasing the glide seat means out of the adjusting barrel and into coupling with the ceiling rail means.

23. The wall system of claim 22 wherein the glide seat means comprises:

a. rod means slidingly received in the adjusting barrel and selectively threadable thereinto; and
b. a glide seat joined to the rod and configured to couple with the ceiling rail means.

24. The wall system of claim 22 further comprising:

a. a cover holder retained in the panel superstructure;
b. a cover clip captured over the glide seat means; and
c. at least one ceiling cover assembly retained between the cover holder and the cover clip and extending between the superstructure and the ceiling to cover the upper glide assembly means when the panel is coupled to the positioning means.

25. The wall system of claim 24 wherein the ceiling cover assembly comprises a first ceiling cover retained on the cover holder and a second ceiling cover retained on the cover clip, the first and second ceiling covers being slidably nestable within each other to thereby enable them to accommodate variations in distance between the superstructure and the ceiling.

26. The wall system of claim 1 further comprising ceiling cover means extending from the superstructure to the ceiling for adjustably covering the upper glide assembly means when the panel is coupled to the positioning means.

27. The wall system of claim 1 further comprising post means for interconnecting selected panels at generally right angles to each other comprising:

a. an upstanding corner post;
b. top and bottom cap assemblies fixed to the top and bottom ends of the corner post, respectively; and
c. post glide means for adjustably supporting the corner post on the floor.

28. The wall system of claim 27 wherein the post glide means comprises:

a. a floor plate;
b. an elongated base glide having a head supported on the floor plate and threads received in the bottom cap assembly; and
c. rivet means for rotatably mounting the base glide to the floor plate, so that the height of the corner post of the floor can be adjusted by rotating the base glide.

29. The wall system of claim 27 further comprising panel connector means mounted to a selected panel adjacent the corner post for selectively gripping and releasing at least one of the top and bottom cap assemblies fixed to the corner post to thereby rigidly interconnect the selected panel and the corner post to each other.

30. The wall system of claim 1 further comprising:

a. an upstanding corner post;
b. top and bottom cap assemblies fixed to the top and bottom ends of the corner post, respectively, at least one of the top and bottom cap assemblies being formed with at least one upstanding lip;
c. post glide means for adjustably supporting the corner post on the floor; and
d. panel connector means mounted to the superstructure of a panel arranged adjacent the corner post for selectively gripping and releasing the upstanding lip of the corner post cap assembly formed therewith to thereby rigidly interconnect the corner post and the adjacent panel to each other.

31. The wall system of claim 30 wherein:

a. at least one of the top and bottom cap assemblies is formed with at least two upstanding lips; and
b. panel connector means are mounted to the superstructure of two panels arranged adjacent the corner post for selectively gripping and releasing respective upstanding lips on the corner post cap assembly formed therewith, so that at least two panels are rigidly interconnectable to the corner post.

32. The wall system of claim 1 further comprising a door module comprising:

a. a door frame;
b. first door frame glide assembly means for supporting the door frame on the floor;
c. second door frame glide assembly means for supporting the door frame on the floor;
d. upper glide assembly means for releasably coupling the door frame to the positioning means;
e. a door; and
f. means for swingingly mounting the door to the door frame.

33. The wall system of claim 32 wherein the door frame comprises:

a. first and second vertical posts having respective slots therein; and
b. a top distance channel assembly joining the top ends of the vertical posts comprising:
   i. a top distance channel of predetermined length; and
   ii. channel hooks fastened to each end of the top distance channel and having respective hooks that engage the slots in the vertical posts to thereby join the top distance channel assembly and the vertical posts into a three-sided frame.

34. The wall system of claim 33 wherein the first door frame glide assembly means comprises:

a. a glide block fixed to the first vertical post;
b. a floor plate supported on the floor generally under the first vertical post;
c. a first elongated glide having a head supported on the floor plate and threadingly received in the glide block in the first vertical post; and
d. rivet means for rotatingly mounting the glide to the floor plate, so that the height of the door frame first vertical post above the floor can be adjusted by rotating the first glide.

35. The wall system of claim 33 wherein the second door frame glide assembly means comprises:

a. a strike bottom having a generally cylindrical portion and a plurality of projections depending from the cylindrical portion, the projections terminating in respective tips that contact the floor and support the cylindrical portion above the floor;

b. a second elongated glide having a head supported on the strike bottom and threadingly received in the glide block in the door frame second vertical post; and c. rivet means for rotatingly mounting the glide to the strike bottom, so that the height of the door frame second vertical post above the floor can be adjusted by rotating the first glide.

36. The wall system of claim 32 further comprising panel connector means mounted to the door frame for releasably gripping an adjacent panel in the arrangement thereof to thereby rigidly interlock the door frame and adjacent panel to each other.

37. The wall system of claim 32 wherein the upper glide assembly means comprises:

a. at least one glide block fixed to the door frame;

b. an adjusting barrel threaded into the glide block;

c. glide seat means slidingly received in the adjusting barrel for releasably coupling to the center rail means; and d. spring means for biasing the glide seat means out of the adjusting block and into coupling with the ceiling rail means.

38. The wall system of claim 32 wherein the means for swingingly mounting the door to the door frame comprises:

a. top pivot holder means for resiliently mounting the top of the door to the door frame; and b. bottom pivot holder means for horizontally and vertically adjusting the position of the bottom of the door relative to the floor.

39. The well system of claim 38 wherein the top pivot holder means comprises:

a. bearing means fastened to the door frame;

b. a top pin having a first end slidingly inserted into an opening in the top of the door and a second end having a hub received for rotation in the bearing means in the door frame, the top pin hub being formed with a ramped slot extending therethrough; and c. spring means for biasing the top pin out of the door, so that the top pin second end can be slid out of the bearing means and into the door against the spring means by applying a force against the slot ramp.

40. The wall system of claim 39 wherein the top pin first end and the opening therefore in the top of the door have respective rectangular cross-sections, so that the top pin ramped slot maintains a predetermined orientation after the top pin is inserted into the door.

41. The wall system of claim 38 wherein the bottom pivot holder means comprises:

a. a floor plate;

b. a bolt passing through the floor plate;

c. a pivot nut threaded onto the bolt and having a shaft end; and d. bearing means mounted to the bottom of the door for receiving the pivot nut shaft end, so that the height of the door above the floor may be adjusted by turning the pivot nut on the bolt.

42. The wall system of claim 38 wherein the bottom pivot holder means comprises:

a. a floor plate having a vertically oriented slot therethrough and a horizontally oriented groove therealong;

b. a bolt having threads that extend through the plate slot and a plate fixed to the bolt and received in and prevented from rotation by the floor plate groove;

c. a pivot nut having a first end threaded onto the bolt threads and a second end formed as a short shaft; and d. bearing means in the bottom of the door for receiving the pivot nut short shaft, so that the height of the door above the floor can be adjusted by turning the pivot nut on the bolt and the bottom of the door can be moved laterally by sliding the bolt and bolt plate within the floor plate slot and the floor plate groove, respectively.

43. A non-progressive wall panel comprising:

a. a superstructure;

b. covering means removably assembled to the superstructure for creating a partition;

c. base means for engaging and for pivotally supporting the superstructure on a floor for pivoting about a horizontal axis into a vertical plane; and d. vertically extendable and retractable means for releasably coupling the superstructure to a ceiling by engagement with a positioning means fastened to the ceiling.

44. The wall panel of claim 43 wherein the base means comprises:

a. an elongated floor channel placed on the floor;

b. at least one base glide assembly connected to the superstructure; and c. clevice means for pivotally supporting the base glide assembly on the floor channel, so that the superstructure and the base glide assembly are pivotable relative to the floor and the floor channel.

45. The wall panel of claim 44 wherein the base glide assembly comprises:

a. an elongated screw supported on the clevice means and having threads that mate with the superstructure; and b. rivet means for rotatingly mounting the screw to the clevice means, so that the height of the superstructure can be adjusted relative to the floor by rotating the screw.

46. The wall panel of claim 44 further comprising:

a. base cover means extending between the covering means and the floor for covering the base means; and b. cover clip means fixed to the floor channel for cooperating therewith to hold the base cover means in place on the panel.

47. The wall panel of claim 43 wherein the panel superstructure comprises:

a. a pair of vertical posts;

b. top distance channel means for joining the upper ends of the vertical posts at a predetermined spacing therebetween;

c. bottom distance channel means for joining the bottom ends of the vertical posts at the predetermined spacing therebetween; and d. glide block means secured to the vertical posts for connecting to the base means, so that the vertical posts and the top distance channel means and the bottom distance channel means cooperate to form a superstructure that is pivotable about the base means.

48. The wall panel of claim 47 wherein:

a. the top distance channel means comprises:

i. a first generally U-shaped channel of predetermined length; and ii. a pair of first generally U-shaped channel hooks, a first channel hook nesting within and being fixed to a respective end of the U-shaped channel, each first channel hook being formed with at least one hook that engages the associated vertical post to thereby join the top distance channel to the vertical posts; and b. the bottom distance channel means comprises:

i. a second generally U-shaped channel of predetermined length; and ii. a pair of second generally U-shaped channel hooks, a second channel hook nesting within and being fixed to a respective end of the U-shaped channel, each second channel hook being formed with at least one hook that engages the associated vertical post to thereby join the bottom distance channel to the vertical posts.

49. The wall panel of claim 47 further comprising:

a. a block fixed to at least one vertical post;

b. a panel connector having a slot and a groove therein;

c. fastener means passing through the panel connector slot and slidingly mounting the panel connector to the block, the panel connector being slidable between a storage position whereat the panel connector groove is remote from the vertical post of an adjacent wall panel and a withdrawn position whereat the panel connector groove is proximate and grippable with the vertical post of an adjacent wall panel to enable selective drawing of the panel connector from the withdrawn position into an installed position whereat the panel connector groove grips cooperating portions of the vertical posts of the panel and an adjacent panel to thereby interconnect the panel and the adjacent panel to each other; and d. spring means for biasing the panel connector from the installed position to the withdrawn position, so that the panel and an adjacent panel can be selectively interconnected.

50. The wall panel of claim 47 wherein:

a. the bottom distance channel means is formed with at least one outwardly extending ledge; and b. the covering means comprises an opaque covering supported on the bottom distance channel means ledge and removably assembled to and spanning the superstructure.

51. The wall panel of claim 47 wherein the covering means comprises:

a. first cover means attached to the top distance channel means for defining a first longitudinally extending space;

b. second cover means attached to the bottom distance channel means for defining a second longitudinally extending space;

c. third cover means attached to the vertical posts of the superstructure for defining respective third longitudinally extending spaces therealong;

d. seal means placed in the first, second, and third longitudinally extending spaces on the top distance channel means, bottom distance channel means, and vertical posts, respectively; and e. a pane of glass received in the seal means and spacing the superstructure to thereby create a transparent panel.

52. The wall panel of claim 47 wherein the upper glide means comprises:

a. a glide block fixed to at least one superstructure vertical post adjacent the top distance channel means thereof;

b. an adjusting barrel having first threads threaded into the glide block and second threads;

c. rod means slidably received in the adjusting barrel and having threads for independently mating with the second threads of the adjusting barrel;

d. a glide seat joined to the rod means and configured to couple with the ceiling; and e. means for biasing the rod means and glide seat away from the adjusting barrel and into coupling with the ceiling, so that the adjusting barrel and glide seat are independently adjustable relative to the panel superstructure and to the ceiling.

53. the wall panel of claim 47 wherein:

a. the panel vertical posts are formed as generally rectangular tubes;

b. the panel vertical post tubes are formed with a plurality of slots in the opposite walls thereof; and c. the panel superstructure further comprises a privacy cover inserted into the vertical posts for blocking light transmission through the slots in the vertical posts.

54. The wall panel of claim 47 wherein:

a. the panel superstructure further comprises center distance channel means for extending between and joining to the vertical posts at a predetermined location between the top distance channel means and the bottom distance channel means; and b. the covering means comprises:

i. an opaque covering assembled to and spanning the superstructure between the vertical posts and the bottom and center distance channel means; and ii. a transparent covering assembled to and spanning the superstructure between the vertical posts and the top and center distance channel means, the transparent covering comprising first cover means attached to the top distance channel means for defining a first longitudinally extending space, second covering means attached to the center distance channel means for defining a second longitudinally extending space, third cover means attached to the vertical posts for defining respective third longitudinally extending spaces therealong, seal means placed in the longitudinally extending spaces of the top and center distance channel means and the vertical posts, and a pane of glass received in the seal means and spanning the superstructure between the top and center distance channel means to thereby create a clerestory panel.

55. The wall panel of claim 43 further comprising:

a. at least one block fixed to the superstructure; and b. panel connector means mounted to the block for being positioned between an installed position whereat the panel connector means is capable of gripping a selected portion of an adjacent panel and a withdrawn position whereat the panel connector means releases the selected portion of the adjacent panel to thereby enable the panel to be selectively interlocked with and released from the adjacent panel.

56. The wall panel of claim 43 wherein the upper glide means comprises:

a. at least one glide block fixed to the superstructure;

b. an adjusting barrel threaded into the glide block;

c. glide seat means slidingly received in the adjusting barrel for releasably coupling to the ceiling; and d. spring means for biasing the glide seat means out of the adjusting barrel and into coupling with the ceiling.

57. The wall panel of claim 56 wherein the glide seat means comprises:

a. a rod slidingly received in the adjusting barrel and selectively threadable thereinto; and b. a glide seat joined to the rod and configured to couple with the ceiling.

58. The wall panel of claim 56 further comprising:

a. a cover holder retained in the panel superstructure;

b. a cover clip captured over the glide seat means; and c. at least one ceiling cover assembly retained by the cover holder and the cover clip and extending between the superstructure and the ceiling to cover the upper glide means when the panel is coupled to the ceiling.

59. The wall panel of claim 58 wherein the ceiling cover assembly comprises a first ceiling cover retained on the cover holder and a second ceiling cover retained on the cover clip, the first and second ceiling covers being slidably nestable within each other to thereby enable them to accommodate variations in the distance between the superstructure and the ceiling.

60. The wall panel of claim 43 further comprising ceiling cover means extending from the superstructure to the ceiling for adjustably covering the upper glide means when the panel is coupled to the ceiling.

* * * * *

UNITED STATES PATENT AND TRADEMARK OFFICE

CERTIFICATE OF CORRECTION

PATENT NO. : 5,159,793

DATED : November 3, 1992

INVENTOR(S) : L. Scott Deugo, Andrew Mansfield, Michael Salzman, Bernhard von Huene and Eberhard von Huene It is certified that error appears in the above-indentified patent and that said Letters Patent is hereby corrected as shown below:

Column 23, line 9:

Delete "adjsuting" and substitute --- adjusting ---.

Signed and Sealed this

Fourteenth Day of December, 1993

*Attest:*

*Attesting Officer*

Bruce Lehman

BRUCE LEHMAN

*Commissioner of Patents and Trademarks*